United States Patent [19]

George et al.

[11] Patent Number: 4,716,963

[45] Date of Patent: Jan. 5, 1988

[54] APPARATUS FOR WELL COMPLETION OPERATIONS

[75] Inventors: Flint R. George, Katy; Bennie C. Gill, Missouri City; David M. Haugen, Houston, all of Tex.

[73] Assignee: Halliburton Company, Duncan, Okla.

[21] Appl. No.: 921,802

[22] Filed: Oct. 20, 1986

Related U.S. Application Data

[63] Continuation of Ser. No. 770,502, Aug. 27, 1985, abandoned.

[51] Int. Cl.[4] ..... E21B 23/06

[52] U.S. Cl. ..... 166/123; 166/144; 166/182

[58] Field of Search ..... 166/123, 124, 125, 143, 166/144, 152, 181, 182, 189

[56] References Cited

U.S. PATENT DOCUMENTS

| | | | |
|---|---|---|---|
| 4,436,150 | 3/1984 | Barker | 166/123 |
| 4,516,634 | 5/1985 | Pitts | 166/125 |
| 4,526,229 | 7/1985 | Dickerson | 166/182 |
| 4,545,431 | 10/1985 | Fore | 166/123 |
| 4,572,290 | 2/1986 | Clifton | 166/125 |

*Primary Examiner*—Stephen J. Novosad
*Assistant Examiner*—Terry Lee Melius
*Attorney, Agent, or Firm*—James R. Duzan

[57] ABSTRACT

Methods and apparatus are provided for setting a packer and for placing a seal assembly into the packer bore on a single trip into the borehole. Such apparatus includes a releasable mechanism coupling the seal assembly in fixed relation to the packer until such time as the packer is at least partially set. Methods and apparatus of the present invention also include a mechanism for hydraulically setting a packer without any manipulation of the tubing string. A pair of hydraulic pistons are utilized to move in opposite directions and exert forces on both a packer actuating sleeve and the packer body to set the packer. Methods and apparatus are provided for actuating well tools in response to the hydrostatic pressure in the well. Through use of such apparatus, a chamber at atmospheric pressure is placed in communication with one side of a hydraulically movable member, the other side of which is exposed to hydrostatic pressure. The low pressure of the atmospheric chamber causes movement of the member to operate the well tool.

9 Claims, 49 Drawing Figures

FIG. 3
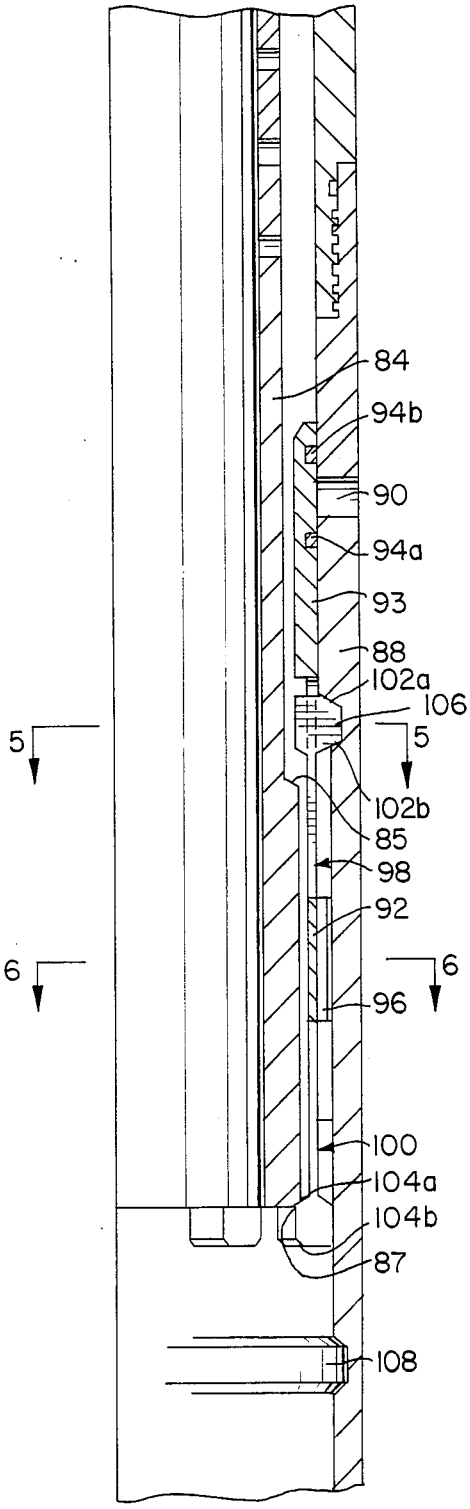
FIG. 6
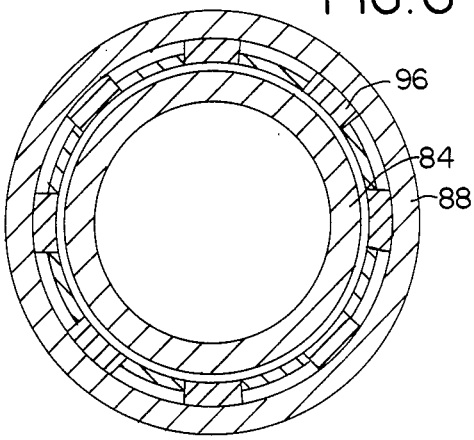
FIG. 5
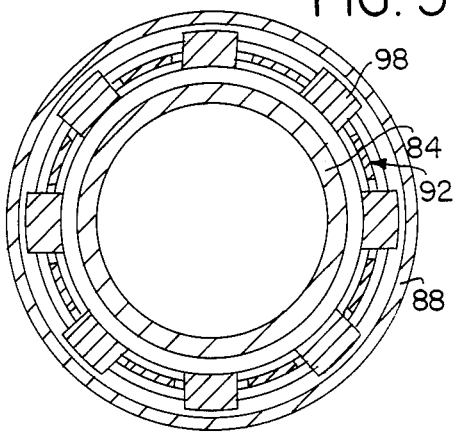
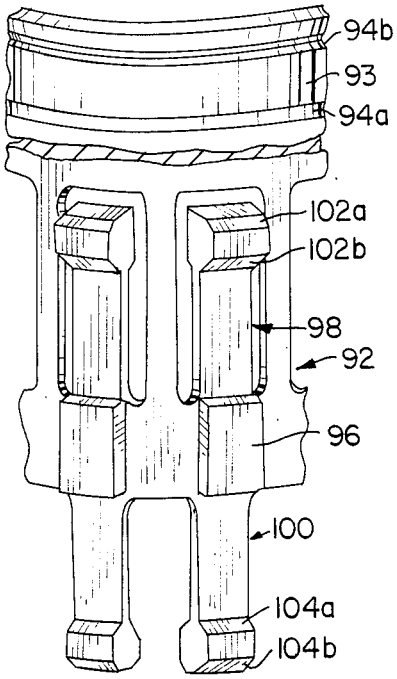
FIG. 4

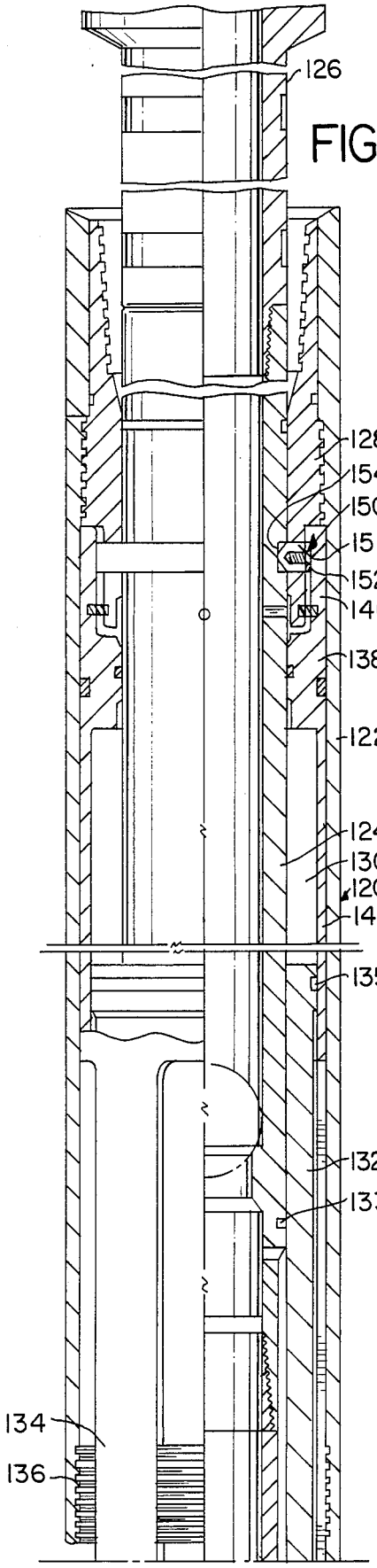
FIG. 10A
FIG. 10B
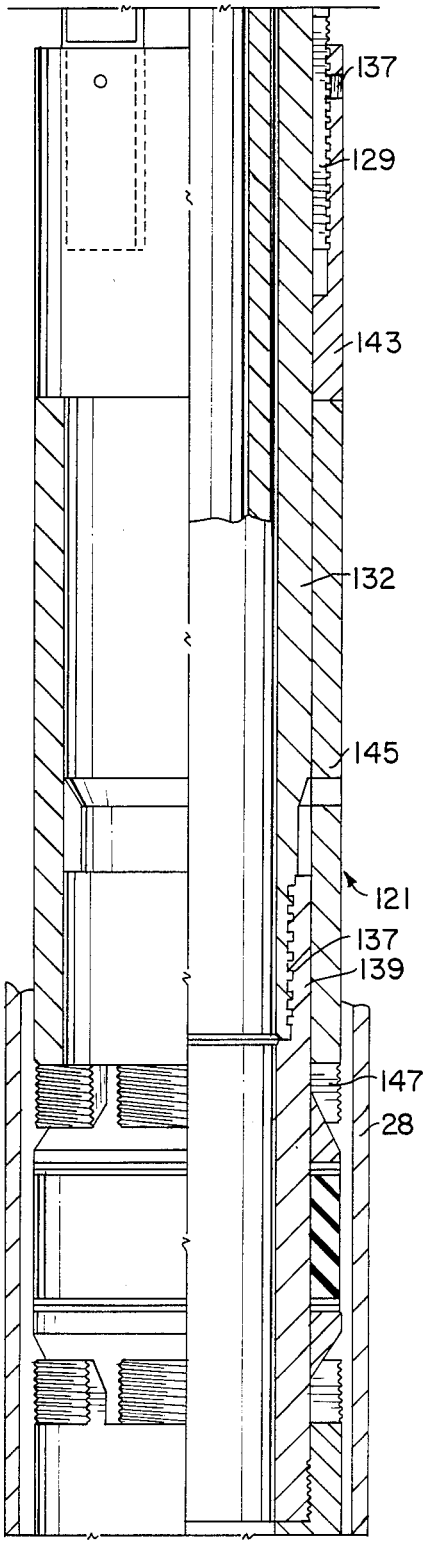

APPARATUS FOR WELL COMPLETION OPERATIONS

This application is a continuation of application Ser. No. 770,502, filed Aug. 27, 1985, now abandoned.

BACKGROUND OF THE INVENTION

The present invention relates generally to methods and apparatus for use in well completion operations, and more particularly relates to methods and apparatus for packing off a well, for placing a seal assembly within a packer, and for actuating apparatus used in well completion operations.

When a packer is set in a well which is to be perforated, it is typically desirable before perforation of the well, to place a seal assembly in the packer bore to facilitate either temporary or permanent production from the well. In many cases, the packer and a perforating mechanism will be run into the well on the end of tubing string. It is also often desirable to utilize an extra long seal assembly to accommodate movement of the tubing string during the life of the well. Conventional technology has required that when a packer was run into the well on the tubing string, if an extra long seal assembly was to be placed in the packer bore, the tubing had to be disconnected from the packer and removed from the well. The extra long seal assembly was then placed on the end of the tubing and run back into the well where it would be stabbed into the packer. This technique presents considerable drawbacks in the removal of the tubing from the well may expend a considerable amount of time and therefore increase the cost of the operation. Additionally, when the tubing is removed from a freely flowing well, the well is normally killed which can lead to formation damage. Other conventional methods for accomodating movement between the tubing and packer are relatively complex and expensive.

The present invention provides a new method and apparatus for running a packer into a well on the end of the tubing string, for setting the packer, and for placing either an extra long seal assembly or another mechanism within the packer bore for accommodating tubing movement, on a single trip with the tubing into the borehole.

Some conventional packer setting techniques include the use of mechanisms which substantially set either an upper or lower packer slip, but require movement of the tubing string to move the packer body in order to set the opposing slip and fully compress the packing element. Such movement of the tubing string is undesirable because it requires movement of a potentially large number of components and requires such components to be subjected to the forces required to set the packer slips.

The present invention also provides a dual-acting packer setting machanism which acts both upon the packer setting sleeve and upon the packer body to fully set the packer without manipulation of the tubing string.

Additionally, many conventional techniques of setting packers and for operating other types of well tools through hydraulic pressure require that the substantial hydraulic pressure needed to set the packer be established in excess of the already existing hydrostatic pressure in the borehole. This substantial increase in pressure, often on the order of 2,500 to 5,000 psi places an undesirable strain on components within the well, as well as upon the well casing itself. Some types of packers and other well tools include integral atmospheric pressure chambers to allow hydrostatic pressure to operate a piston or other movable mechanism. Devices with these integral atmospheric pressure chambers may seize under the hydrostatic pressure in the well or may actuate prematurely. Additionally, because of the time such air chambers may be exposed to the hydrostatic pressure in the well, the air chambers may leak, rendering them inoperative.

The present invention provides a new method and apparatus for setting packers and for operating other types of downhole equipment, such as, for example, tubing releases or firing heads, through use of the preexisting hydrostatic pressure in the well through placement of a separate chamber of reduced pressure to actuate such packer or other well tool.

SUMMARY OF THE INVENTION

A method and apparatus for setting a packer and for placing seals, or other mechanisms to accomodate movement of the tubing string, within the packer in a single trip into the borehole, in accordance with the present invention, includes at least one hydraulically movable member, such as a hydraulic piston, which is coupled or otherwise operatively associated with a setting mechanism for setting at least one of the sets of slips on the packer. In one preferred embodiment, wherein a seal assembly will be placed in the packer bore, such apparatus will include a housing and an inner mandrel. The inner mandrel is suspended from the seal assembly which is in turn suspended from the tubing string.

In such preferred embodiment, the inner mandrel will be initially secured, by a coupling mechanism, in a fixed relation to the housing. The coupling mechanism is preferably configured to be releasable only after the packer has been set. Again in one preferred embodiment, the coupling mechanism is released only after a hydraulic piston utilized to set the packer is moved from an initial position to a second position in the course of setting the packer. Once the coupling mechanism is released, the seal assembly can be lowered into position within the packer bore. Such an apparatus may be constructed either as an integral part of a packer or as a setting tool to be secured to a separate packer.

A method and apparatus for hydraulically setting both slips of a packer independent of movement of the tubing, in accordance with the present invention, preferably includes the use of a pair of hydraulic members, such as hydraulic pistons. Each hydraulic piston will preferably be exposed to a single source of hydraulic pressure. In one preferred embodiment, one of the hydraulic pistons will be designed to move in a first longitudinal direction and will be coupled, or otherwise operatively associated with the packer body. The second hydraulic piston will be designed to move in the opposite longitudinal direction in response to the hydraulic pressure and will be attached to a packer actuating sleeve. Accordingly, when hydraulic pressure is applied to the pistons, the pistons serve to move in opposing directions and to set the packer without any movement of the tubing string. A setting apparatus in accordance with the present invention can either be formed as an integral part of a hydraulically set packer or as a setting tool for attachment to a separate packer. Additionally, in one preferred embodiment of the invention, the setting tool will include a mechanism as described above for placing a sealing device in the packer bore on a single trip into the borehole.

Also within the scope of the present invention is a method and apparatus for actuating well tools which are operable in response to a hydraulically movable mechanism. In particular, such method and apparatus is concerned with allowing such well tools to be operated through use of the existing hydrostatic pressure within the well. Fundamentally, the invention includes the use of an actuator which includes a chamber which is at atmospheric pressure. The actuator is run into the well, such as on a wireline or slickline, where it engages the well tool to be actuated. A mechanism is provided, such as a hydraulically actuable piston or a mechanically actuable piston, which will place the atmospheric chamber in fluid communication with one side of a hydraulically movable member, the other side of which is exposed to hydrostatic pressure. The relatively low pressure in the atmospheric chamber will allow the hydrostatic pressure to move the member thus actuating the well tool. The present invention also encompasses a plurality of well tools which are operable in response to such an atmospheric chamber actuator, including a tubing release sub, a packer setting mechanism, and a perforating gun firing head.

BRIEF DESCRIPTION OF THE DRAWINGS

FIG. 3 depicts the valve assembly of the apparatus of FIG. 2 in greater detail.

FIG. 4 depicts a portion of the slidable member of the valve assembly of FIG. 3, illustrated in a perspective view.

FIG. 5 depicts the valve assembly of FIG. 3 in horizontal section along lines 5—5 in FIG. 3.

FIG. 6 depicts the valve assembly of FIG. 3 in horizontal section along lines 6—6 in FIG. 3.

FIGS. 10A–B depict a seal assembly and a packer setting tool adapted to be secured to a separate packer in accordance with the present invention, illustrated in partial cut away and vertical section.

DETAILED DESCRIPTION OF A PREFERRED EMBODIMENT

Figure 1:
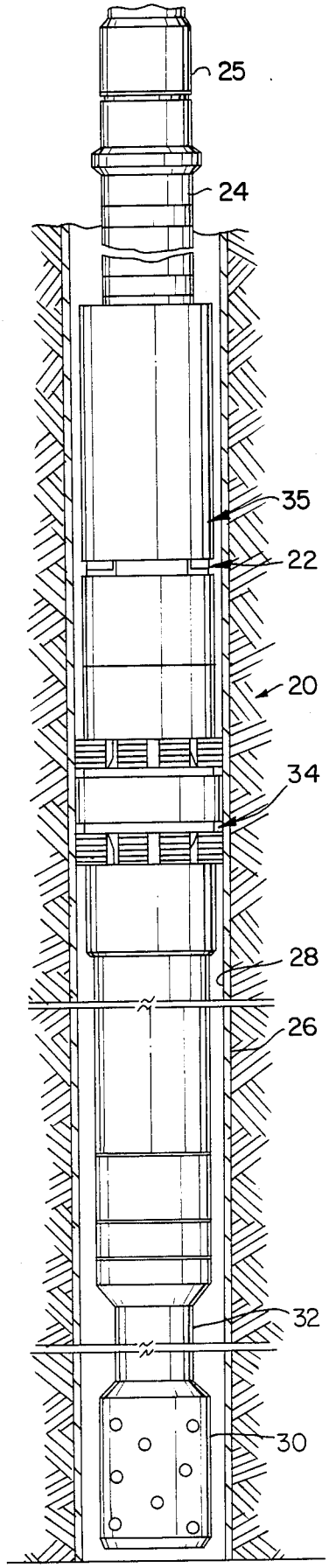
FIG. 1 depicts a hydraulically set packer in accordance with the present invention in a typical operating configuration with a seal assembly and a perforating gun.

Referring now to the drawings in more detail, and particularly to FIG. 1, therein is shown a hydraulically set packer and seal assembly unit 20 in accordance with the present invention. Unit 20 includes a hydraulically set packer 22 and a seal assembly 24 which are suspended from tubing string 25. Unit 20 is depicted in a borehole 26 lined with casing 28 in a conventional manner. A perforating gun 30 is coupled to a tubular extension 32 coupled to the lower end of packer 22, as will be discussed more fully later herein.

The apparatus depicted in FIG. 1 may be utilized in a well completion operation to isolate a portion of the well beneath the packer, to place an extra long seal assembly in place within the packer bore, and perforate the well, all in a single trip into the borehole. In the embodiment described and illustrated herein, tubing movement will be accomodated by the placing of an extra long seal assembly into the packer. Alternative apparatus may be utilized in accordance with the present invention to accommodate tubing movement. For example, a slickjoint having a seal assembly placed in sealing engagement therewith may be placed in the packer bore to engage a seal therein in place of the extra long seal assembly described above.

Hydraulically set packer 22 includes a conventional packer mechanism, indicated generally at 34, coupled with an integral hydraulic setting tool, indicated generally at 36. As indicated earlier herein, setting tool 36 is designed to allow the placing of seal assembly 24 into the packer bore after packer 22 is set.

Figure 2A:
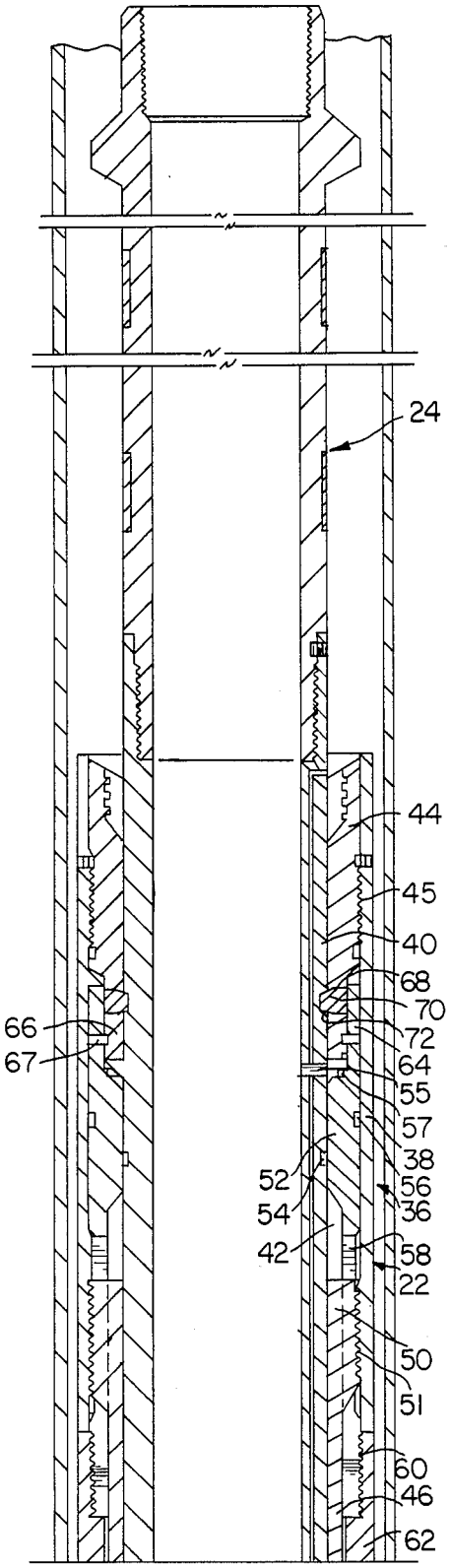
FIGS. 2A–C depict the apparatus of FIG. 1, illustrated substantially in vertical section.
Figure 2B:
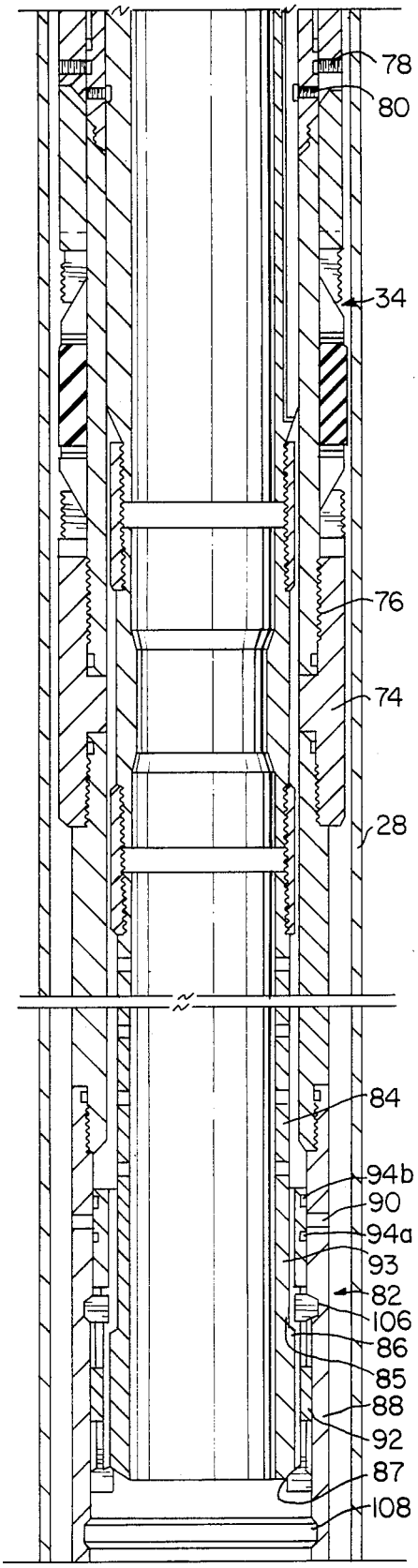
Figure 2C:
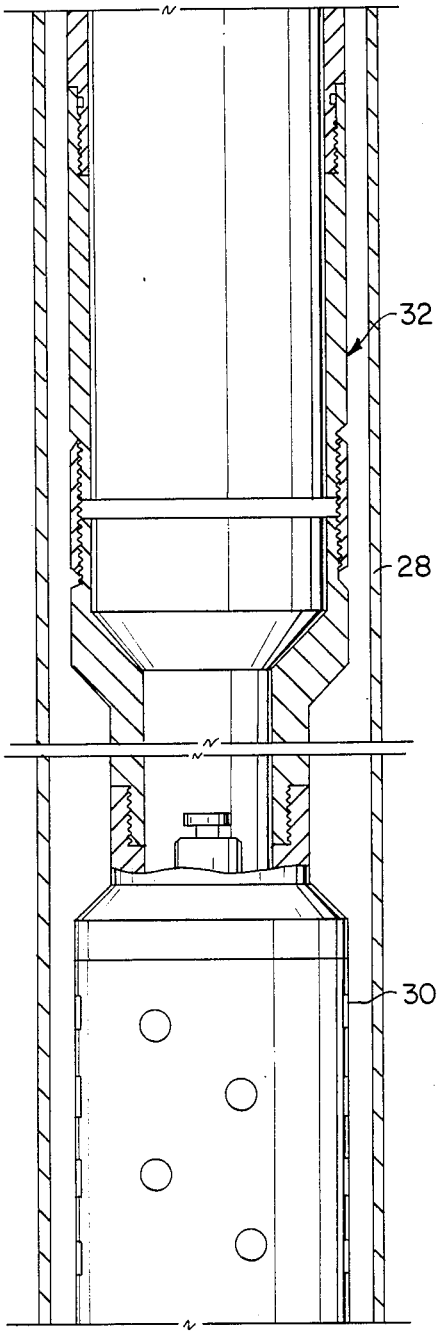

Referring now to FIGS. 2A–C, therein is shown the apparatus of FIG. 1 illustrated in vertical section within casing 30. Packer 22 includes a conventional packer mechanism 34, which is integral with setting tool 36. Setting tool 36 includes a housing 38 and an inner mandrel 40 situated concentrically thereto. Housing 38 and mandrel 40 cooperatively define an annular chamber 42 bounded at the top by a cap 44 and at the bottom by a concentric sleeve 46. Cap 44 is threadably coupled, at 45, to housing 38. Concentric sleeve 46 includes a plurality of radially spaced, outwardly extending flanges 50 which threadably couple, at 51, to housing 38. By virtue of the circumferential spacing of flanges 50, a plurality of longitudinal slots are formed through concentric sleeve 46.

Housed within annulus 42 is hydraulic piston 52. Piston 52 is slidably and sealingly engaged between housing 38 and inner mandrel 40. Inner mandrel 40 includes a plurality of ports 55 proximate upper surface 57 of piston 52. A plurality of conventional seals, such as O-ring seals, 54, 56 seal between piston 52 and inner mandrel 40 and housing 38. The upper end of piston 52 includes an upwardly extending tubular flange 64. Flange 64 extends along a radially outward portion of annulus 42. The lower end of piston 52 includes a plurality of longitudinal extensions 58 adapted to extend through the above-described slots in concentric sleeve 46 and to threadably couple, at 60, to packer actuating sleeve 62.

Cap 44 at the top of housing 38 includes a tubular flange 66 which extends proximate inner mandrel 40 and is sealingly engaged therewith. In an initial position, tubular flange 64 of piston 52 will overlie tubular flange 66 of cap 44. Piston 52 will be coupled by a shear pin 67 to tubular flange 66. The shear strength of shear pin 67 will determine the activation pressure for causing setting tool 26 to set packer mechanism 34. Tubular flange 66 includes a plurality of apertures 68. In the initial position, as illustrated, a plurality of notches 72 in inner mandrel 40 are aligned with apertures 68. A plurality of lugs 70 extend through apertures 68 and engage beveled notches 72 in inner mandrel 40, securing inner mandrel 40 in fixed relation to cap 44, and thereby also to housing 38. Lugs 70 are retained in locking engagement with notches 72 by tubular flange 64 of piston 52 which prevents radial movement of lugs 70 when tubular flange 64 is situated concentric to flange 66 as illustrated in FIG. 2.

Concentric sleeve 46 couples housing 38 to packer body sleeve 74 at threaded coupling 76. As previously described, piston 52 is coupled, at 60, to packer actuating sleeve 62. Packer actuating sleeve 62 is coupled by a shear pin 78 to concentric sleeve 46. Concentric sleeve 46 is in turn coupled by a shear pin 80 to inner mandrel 40. Shear pin coupling 78 and 80 prevent inadvertent or premature setting of packer mechanism 34.

The embodiment of packer and seal assembly unit 20 depicted in FIG. 2 includes an optional fluid valve, indicated generally at 82. One intended use of optional valve 82 will be to allow perforating of the well, testing of the well production through ports 90 and valve 82, and subsequent shutting in of the well.

In valve 82, a ported extension 84 is coupled to the lower end of inner mandrel 40. Ported extension 84 includes an outwardly extending peripheral flange 86, having upper and lower beveled surfaces 85 and 87, respectively. A housing extension 88 is coupled to packer body 74. Housing extension 88 includes a plurality of ports 90. Valve 82 operates to close ports 90 by a slidable member 92. Slidable member 92 includes a sealing portion 93 with a plurality of spaced seals 94*a* and 94*b*, adapted to straddle ports 90 and thereby prevent fluid flow therethrough.

Referring now also to FIGS. 4–6, therein slidable member 92 is depicted in greater detail. Slidable member 92 includes a web portion 96 coupled to sealing portion 93. A first set of collet fingers, indicated generally at 98, extend longitudinally from web portion 96 in a first direction while a second set of collet fingers, indicated generally at 100, extending longitudinally from web portion 96 in a second direction. First and second sets of collet fingers 98, 100, each include beveled surfaces 102*a*, 102*b* and 104*a*, 104*b*, respectively. First collet fingers are adapted to be engageable with a first peripheral notch 106 in housing extension 88. Second collet fingers 100 are adapted to be engageable with a second peripheral notch 108 in housing extension 88. An upward movement of ported extension 84 will cause upper surface 85 of flange 86 to engage upper collet fingers 98, and to move slidable member to a first position, as illustrated in FIG. 2, wherein first collet fingers 98 are engaged with slot 106 and seal members 94*a* and 94*b* straddle port 90, preventing fluid flow therethrough. A downward movement of ported extension 84 will cause lower surface 87 of flange 86 to engage lower collet finger 100 and to move slidable member 92 to a second position, as illustrated in FIG. 3, wherein second collet fingers 100 are engaged with notch 108, and sealing portion 93, including seal 94*b*, is situated below port 90, thereby allowing fluid flow through port 90 in housing extension 88 and into ported extension 84 on inner mandrel 40.

Figure 7:
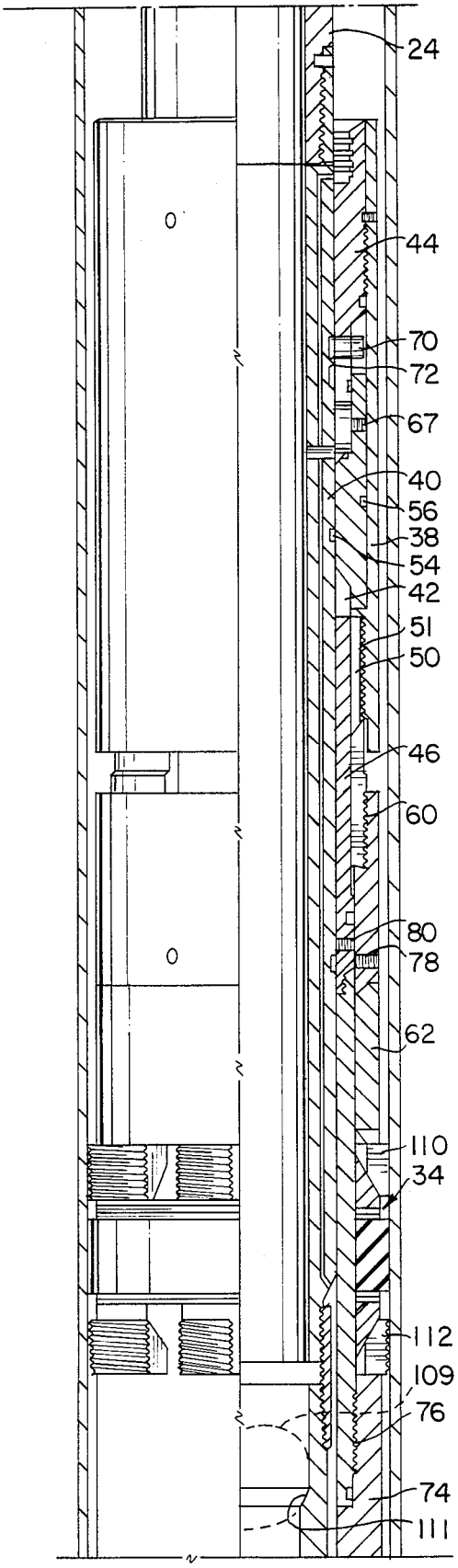
FIG. 7 depicts the hydraulically set packer of FIG. 2 after it has been actuated to set the packer mechanism, illustrated in half vertical section.

Referring now also to FIG. 7, therein is shown hydraulically set packer and seal assembly unit 20 after packer mechanism 34 has been set and seal assembly 24 has been moved slightly downward, releasing inner mandrel 40 and attached seal assembly 24 from housing 38. In operation, packer 26 will be set through the use of hydraulic pressure in the tubing string. A sealing device, such as a ball 109 (illustrated in phantom lines) or retrievable plug, may be lowered down the tubing string and seated against seating flange 111, in a conventional manner. Hydraulic pressure may then be established within inner mandrel 40 by pumping fluid down tubing string 25 and seal assembly 24.

Fluid pressure within inner mandrel 40 will pass through ports 55 and act upon piston 52. Once the shear force of shear pins 67 and 78 is reached, piston 52 will move downwardly. This downward movement causes upper packer setting sleeve 62 to similarly move downwardly and urge upper packer slips 110 into engagement with casing 28. As with some conventional setting tools and packers, an upward movement of packer and seal assembly unit 20 may be utilized to fully set packer 22.

After packer mechanism 34 has been set, seal assembly 24 may be moved into position within the packer bore. The downward movement of piston 52 causes tubular flange 64 of piston 52 to move away from lugs 70, establishing a radial recess into which lugs 70 can move. A setting down of weight on the tubing string, and thereby on seal assembly 24, will cause shear pin 80 to shear. Simultaneously, the beveled surfaces of notch 72 in mandrel 40 will urge lugs 70 radially outwardly, thereby releasing mandrel 40 from housing 38.

Figure 8:
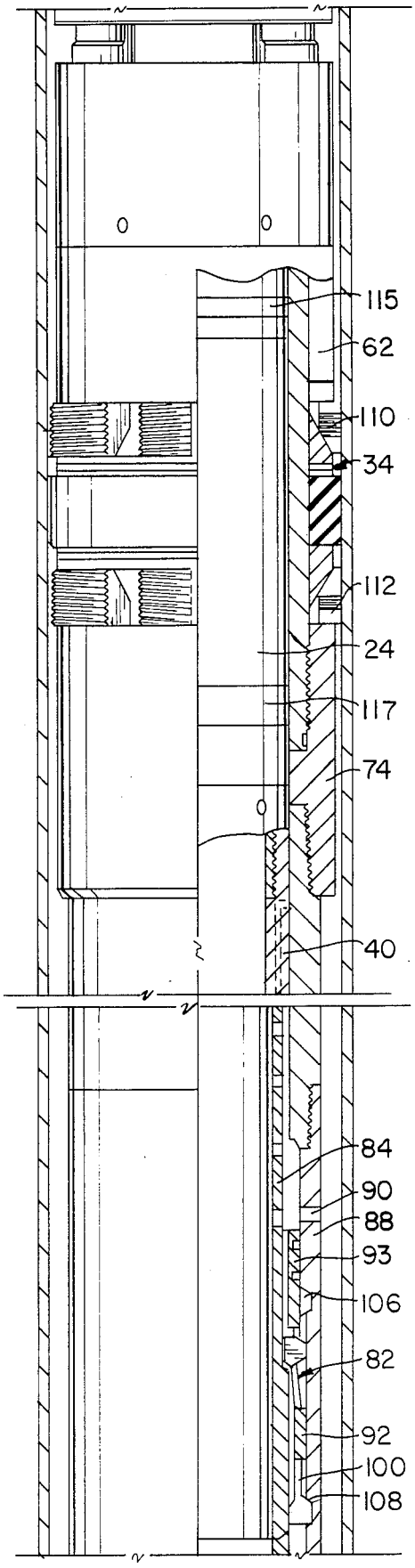
FIG. 8 depicts the lower portion of the apparatus of FIG. 2, after the seal assembly has been lowered into a desired position within the packer bore, illustrated in cut away vertical section.

Referring now also to FIG. 8, therein is shown packer and seal assembly unit 20 after seal assembly 24 has been fully lowered, through movement of tubing string 25, to place seals 115, 117 into the packer bore. During the initial downward movement of inner mandrel 40, the lower surface 87 of ported extension 84 will contact second collet fingers 100 and move slidable member 92 downwardly until second collet fingers 100 engage notch 108 in housing extension 88. When second collet fingers 100 engage notch 108 they will move out of the path of ported extension 84 and allow inner mandrel 40 and seal assembly 24 to continue moving downwardly without further movement of slidable member 92. Once seal assembly 24 has been moved to its desired location, as depicted in FIG. 8, the well is in condition for permanent production through ports 90 in housing extension 88, ported extension 84, and seal assembly 24. If it is desired to shut in the well, seal assembly 24 and inner member 40 may be removed from the packer bore. This upward movement of the above components will cause valve 82 to close, shuting in the well.

Figure 9:
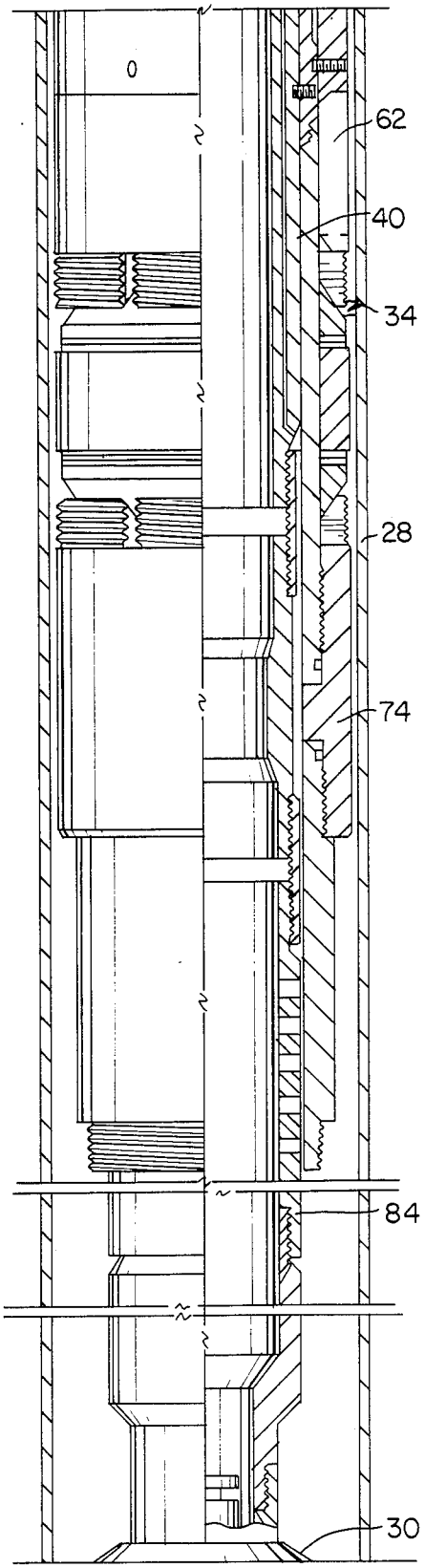
FIG. 9 depicts an alternative attachment of a perforating gun to the hydraulically set packer and seal assembly of FIG. 2.

Referring now to FIG. 9, therein is shown an optional configuration for coupling a hydraulically set packer and seal assembly unit 20, as illustrated in FIGS. 1 and 2, and a perforating gun 30. Perforating gun 30 is coupled directly to the lower end of ported extension 84, which is in turn coupled through inner mandrel 40 to seal assembly 24. In the configuration depicted in FIG. 9, valve 82 depicted in FIG. 2 would not be utilized. In this configuration, the seal assembly may be lowered into place, and the well perforated, leaving perforating gun 30 coupled to the lower end of ported extension 84.

Referring now to FIGS. 10A–B, therein is shown a hydraulic setting tool 120 with a packer 121, operable substantially in the same manner as the hydraulically set packer with integral setting tool described earlier herein. Setting tool 120, however, is adapted to be secured as a unit to a separate packer. Setting tool 120 is again adapted to facilitate the setting of the packer and to allow placement of a seal assembly 126 in the packer bore in a single trip into the well. Because of the substantial similarities in structure and operation between hydraulically set packer 22, illustrated in FIGS. 1–8. hydraulic setting tool 120, primarily only the differences in structure or operation will be discussed in detail herein.

Setting tool 120 includes a housing 122 and an inner mandrel 124, which couples at the top to seal assembly 126. The lower end of inner mandrel 124 may couple to a perforated extension (not illustrated), as previously discussed in reference to the hydraulically set packer 22 of FIGS. 1–8, or with other mechanisms as may be desired. An endcap 128 closes the upper end of an annulus 130 formed between housing 122 and inner mandrel 124.

Figure 13:
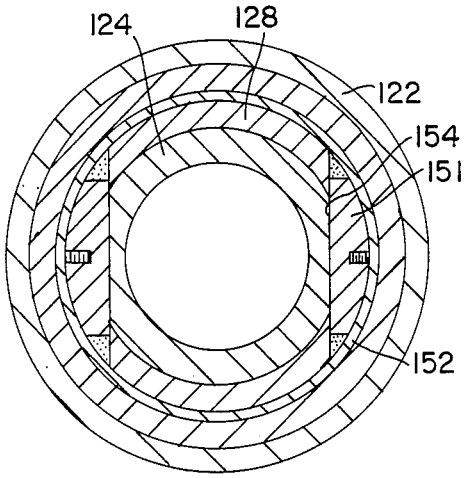
FIG. 13 depicts the apparatus of FIG. 10 in horizontal section along lines 13—13 in FIG. 10.
Figure 11:
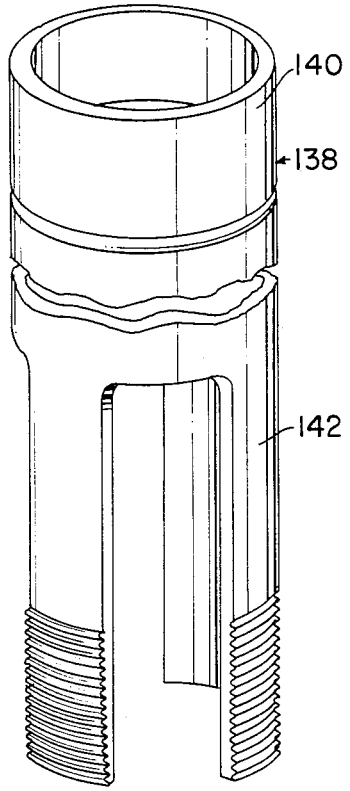
FIG. 11 depicts the piston, housing and mandrel of the setting tool of FIG. 10, illustrated in a perspective cut away view.
Figure 12:
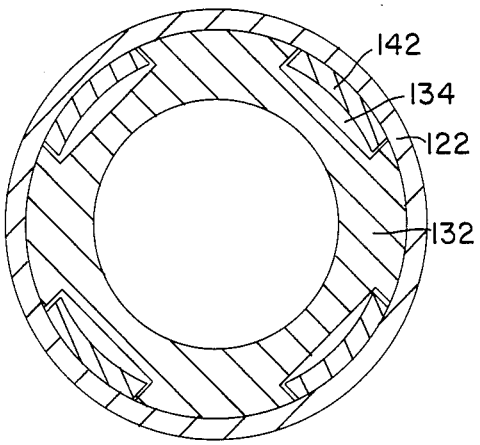
FIG. 12 depicts the apparatus of FIG. 10 in horizontal section along lines 12—12 in FIG. 10.
Figure 12:
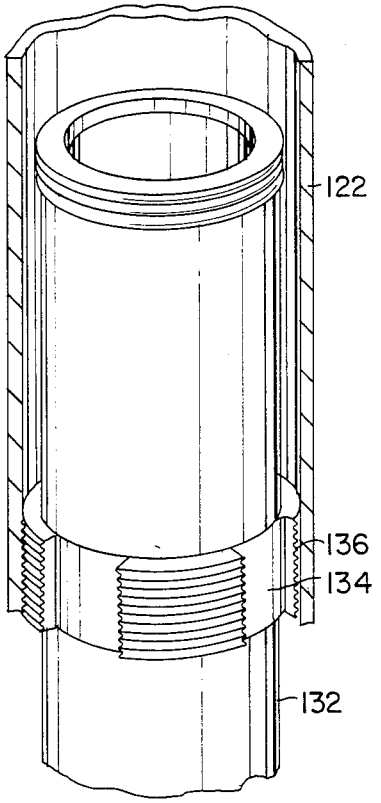

Referring now also to FIGS. 11–13, the lower end of annulus 130 is closed by a lower mandrel 132. Seals are provided between lower mandrel 132 and inner mandrel 124 and housing 122 by seals 133 and 135, respectively. Lower mandrel 132 is coupled at an intermediate position to housing 122 by a plurality of radially spaced threaded couplings, indicated generally at 136, having a plurality of longitudinal slots 134 therebetween. A lower portion of lower mandrel 132 includes a threaded coupling 137 adapted to engage the packer body 139.

A piston 138 is housed within annulus 130 and is sealingly engaged with inner mandrel 124 and housing 122. Piston 138 includes an upper tubular flange 140. Extending from the lower end of piston 138 are a plurality of longitudinal extensions, indicated generally at 142, which treadably couple, at 129, to an adjustment sleeve 143. Longitudinal extensions 142 are adapted to be slidable through slots 134 in lower mandrel 132. Adjustment sleeve 143 contacts packer setting sleeve 145 of packer 121. Adjustment sleeve 143 facilitates the adaption of setting tool 120 to different packers or to variances in packer setting sleeves. Adjustment sleeve 143 will be screwed into contact with packer setting sleeve 145 and secured in position with set screw 137.

Inner mandrel 124 is coupled to endcap 128 by an alternative coupling mechanism 150 to that illustrated in reference to hydraulically set packer 22. Coupling mechanism 150 includes a pair of lugs 151 engageable with flats 154 in opposing sides of inner mandrel 124. Lugs 151 are secured, such as by screws, to a frangible band 152. In one preferred embodiment, frangible band 152 is a steel band approximately 1/16 of an inch thick. Lugs 151 are also initially secured in position by the presence of tubular flange 140 of piston 138 extending over band 152.

Figure 14A:
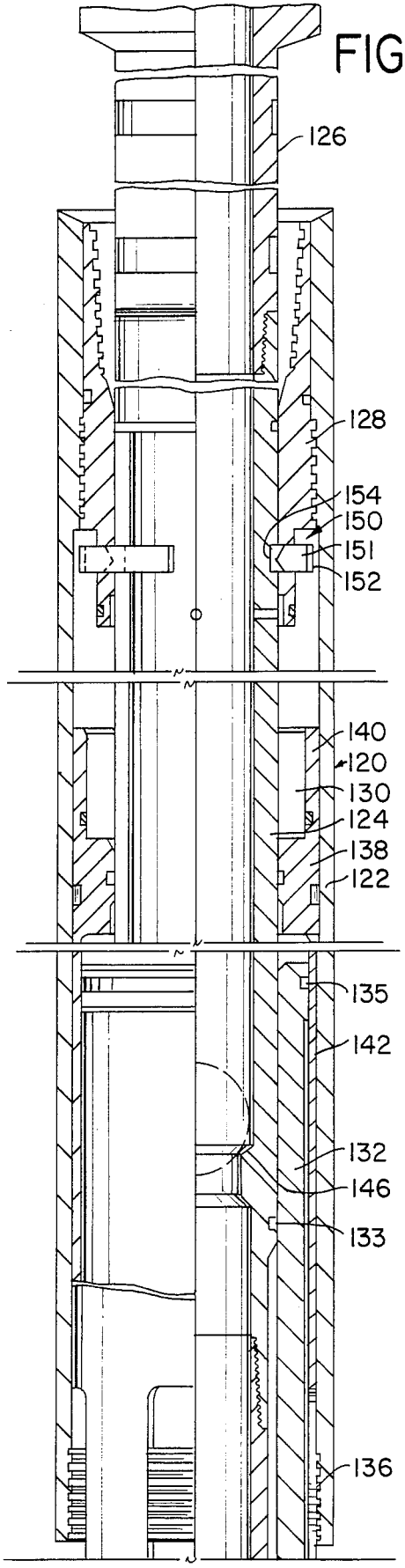
FIGS. 14A–B depict the apparatus of FIG. 10 after the setting tool has been actuated to set the packer and the seal assembly has been released from the setting tool, illustrated substantially in vertical section.
Figure 14B:
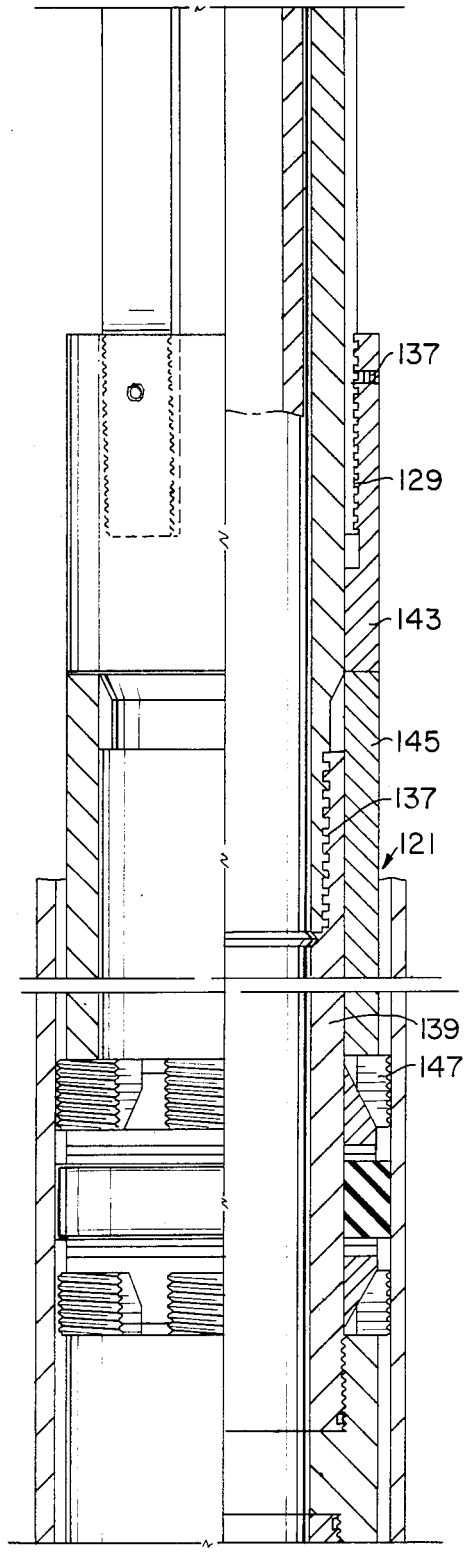

Referring now also to FIGS. 14A–B, therein is shown setting tool 120 after it has been actuated to set packer 121. Setting tool 120 is again actuated by hydraulic pressure in the tubing string. As previously described, a sealing ball may be circulated down the tubing string to engage sealing surface 146 in inner mandrel 124. In the illustrated embodiment, sealing surface is formed in a lower portion of inner mandrel 124. Alternatively, it may be desirable to attach a separate member to inner mandrel 124, such as perforated extension 84 shown in FIG. 2, which includes a seat for sealing ball 144.

In response to hydraulic pressure in tubing string 125 passing through port 141, piston 138 moves downwardly, moving tubular flange 140 from proximate coupling assembly 150. Movement of piston 138 causes adjustable sleeve 143 to push against packer actuating sleeve 145 to set at least upper slips 147 of packer 121. Again, some longitudinal manipulation of the tubing string, and therefore of packer 121 may be utilized to fully set packer 121.

Once packer 121 is set, inner mandrel 124 and attached seal assembly 126 may be decoupled from housing 122 and packer 121. Rotation of seal assembly 126, and thereby of inner mandrel 124, will apply torque to frangible band 152 through lugs 151 and will cause band 152 to break, allowing lugs 151 to move radially outwardly, thereby decoupling inner mandrel 124 and seal assembly 126 from packer 121. Seal assembly 126 may then be lowered into engagement in the packer bore as previously described with respect to hydraulically set packer 22.

Figure 15:
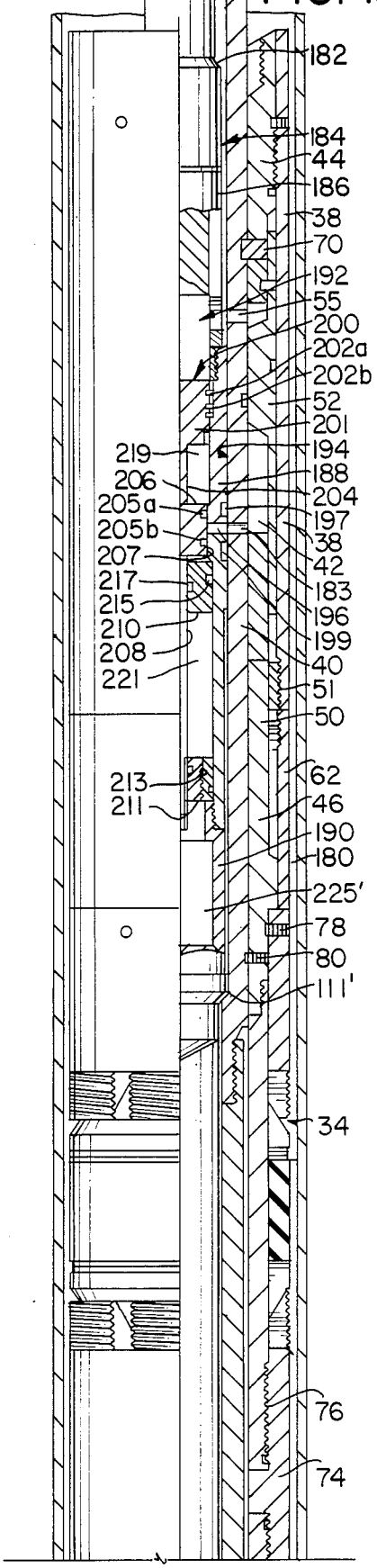
FIG. 15 depicts a hydraulically set packer with an atmospheric chamber actuator for operating the packer in accordance with the present invention, illustrated in half vertical section.

Referring now to FIG. 15, therein is shown a hydraulically set packer 180 with an integral setting tool, operable in response to a separate atmospheric chamber actuator 182. Air chamber actuator 182 allows packer 180 to be set in response to the existing hydrostatic pressure in the well. As will be discussed more fully later herein, a relatively low increase over the hydrostatic pressure will be established within the tubing string to actuate the actuator. The existing hydrostatic pressure will then be utilized to set the packer.

Packer 180 is identical to packer 22 depicted in FIGS. 1–8, which the exceptions that beneath piston 52, additional ports 183 have been added in inner mandrel 40 and seating surface 111 has been moved upwardly in inner mandrel 40 as indicated at 111'. The remaining components in packer 180 are constructed and operate identically as previously described in the discussion of packer 22. Accordingly, such remaining components have been numbered similarly.

Air chamber actuator 182 may be suspended from a wireline or a slickline and will typically be lowered into the well only when it is desired to set packer 180. Actuator 182 includes a housing 184 adapted to withstand the hydrostatic pressure in the well. Housing 184 may be formed of a plurality of members, such as top housing 186, central housing 188 and bullplug housing 190. Housing 184 includes a ported section, indicated generally at 192, communicating the exterior of housing 184 with an internal chamber 193. The diameter of ported section 192 is such that when atmospheric chamber actuator is situated in packer 180, as illustrated, fluid may flow between housing 184 and inner mandrel 40.

Housing 184 includes a sealing section, indicated generally at 194, which is of an enlarged diameter relative to the diameter of ported section 192. Sealing section 194 includes a port 196 which is adapted to align with port 183 in inner mandrel 40 when a seating surface 198 on housing 184 engages seating surface 111' on inner mandrel 40. Situated on each side of port 196 are seals 197, 199 adapted to withstand the hydrostatic pressure to which the hydraulic coupling between housing 184 and inner mandrel 40 will be subjected. Those skilled in the art will recognize that different types of seals may be used. In some applications, one or more O-ring seals may be satisfactory. In one preferred embodiment, seals 197 and 199 are each formed of a plurality of Chevron seals appropriately situated to withstand the hydrostatic pressure.

Located within housing 184 at a lower end of chamber 193 is a first piston, indicated generally at 200. First piston 200 includes a first portion 201 coupled by one or more shear pins **202*a*, 202*b* to housing 184. Piston 200 then preferably includes an extension portion 204 which couples first portion 201 to a second portion 206. Second portion 206 is of a smaller diameter than first piston portion 201. Second portion 206 includes a plurality of seals 205*a*, 205*b*, such as conventional O-ring seals, which straddle port 196 in housing 184 and seal against a sealing surface 207 in housing 184, thereby preventing fluid flow through port 196. Piston 200 then includes an extension 208 which extends through a guide member 211 held within housing 184. A pair of chambers 219, 221 are formed in actuator 182. Chambers 219 and 221 are both sealed from the hydrostatic pressure in the borehole and therefore are at atmospheric pressure. Actuator 182 includes a damping piston 210, with seals 215, 217 between the interior of housing 184 and extension 208. Guide member 211 includes a check valve 213. The cracking pressure of check valve 213** will preferably be adjustable within a range of pressures, for example, 5 to 50 psi. As will be apparent from the discussion to follow, the actual cracking pressure utilized will be dependent upon the conformity and dimensions of atmospheric chamber actuator as well as upon downhole conditions.

As discussed earlier herein, the actual setting of packer 180 will be accomplished through use of the existing hydrostatic pressure in the well. The activation pressure of atmospheric chamber actuator 182 will preferably be established at some level providing a safety margin over the hydrostatic pressure, for example, at five hundred to one thousand pounds above the hydrostatic pressure in the well at the depth of the actuator. This activation pressure is established by the shear limit of shear pins **202*a* and 202*b* securing piston 200 in position within housing 184**.

Figure 16:
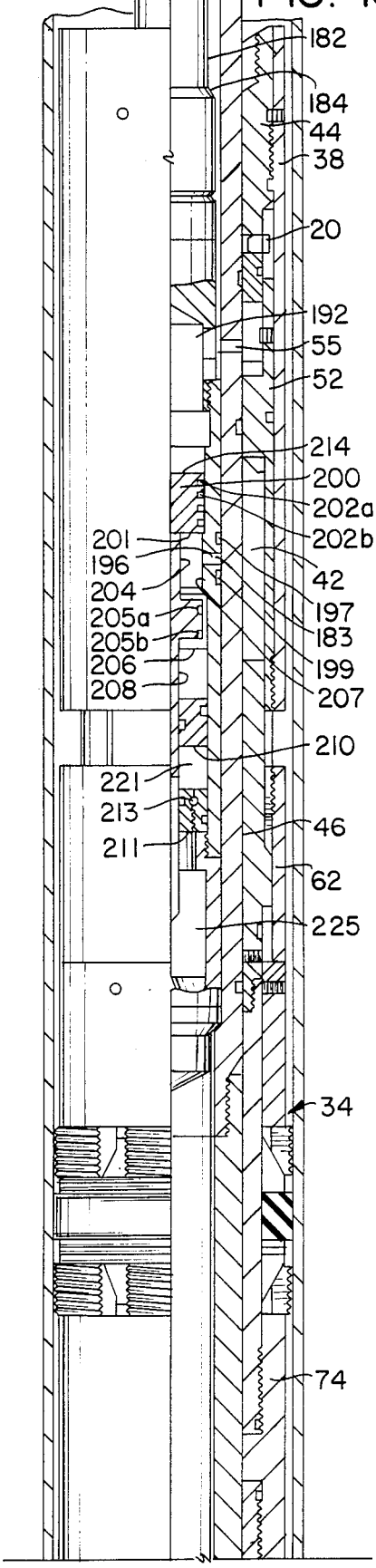
FIG. 16 depicts the apparatus of FIG. 15 after the atmospheric chamber actuator has been activated to set the packer, illustrated in half vertical section.

Referring now to FIG. 16, therein is shown packer 180 after atmospheric chamber actuator 182 has been activated to set packer 180. In operation, when it is desired to set packer 180, the activation pressure is applied within the tubing string, and thereby in chamber 193 to top surface 214 of piston 200. When the activation pressure is reached, shear pins **202*a*, 202*b* will shear and piston 200 will move downwardly, removing seals 205*a* and 205*b* from proximate aperture 196. Because chambers 219 and 221 in housing 184 are at atmospheric pressure, a low pressure is established in annulus 42 on the downward side of piston 52, relative to the hydrostatic pressure operating through port 55 on the upper surface of piston 52, causing piston 52 to move downwardly to set the packer in the manner previously described. Fluid from annulus 42 beneath piston 52 will flow through apertures 183 and 196, and into chambers 219 and 221 in actuator 182. Movement of piston 200 will be stopped by a ledge at the edge of inner sealing surface 205. Fluid may flow around second portion 206 of piston 200 where the fluid will contact damping piston 210. Movement of damping piston 210 will be restricted by fluid in chamber 221. As pressure is applied to damping piston 210, the fluid in chamber 221 will gradually be released from chamber 221 through check valve 213 into lower chamber 225. This damping action slows the movement of piston 52 and prevents piston 52 from moving too abruptly and possibly damaging or improperly setting packer 180. After packer 180 is set, atmospheric chamber actuator 182 may be removed from the well and seal assembly 126** lowered into position in the manner described earlier herein.

Figure 17A:
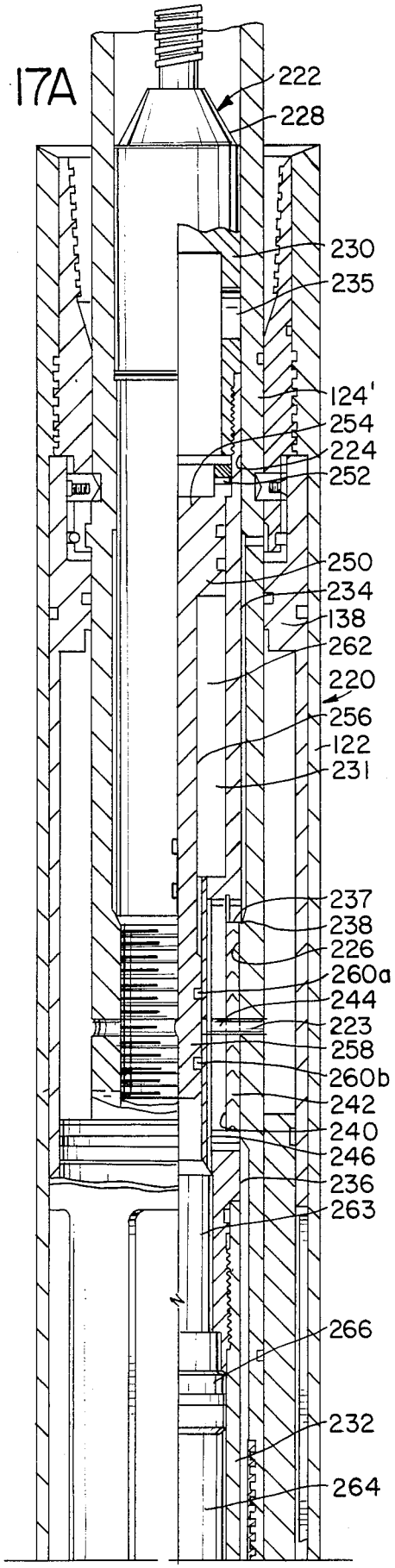
FIGS. 17A–B depict a setting tool in conjunction with a packer an an atmospheric chamber actuator for activating the setting tool in accordance with the present invention, illustrated partially in a cut away view and partially in vertical section.
Figure 17B:
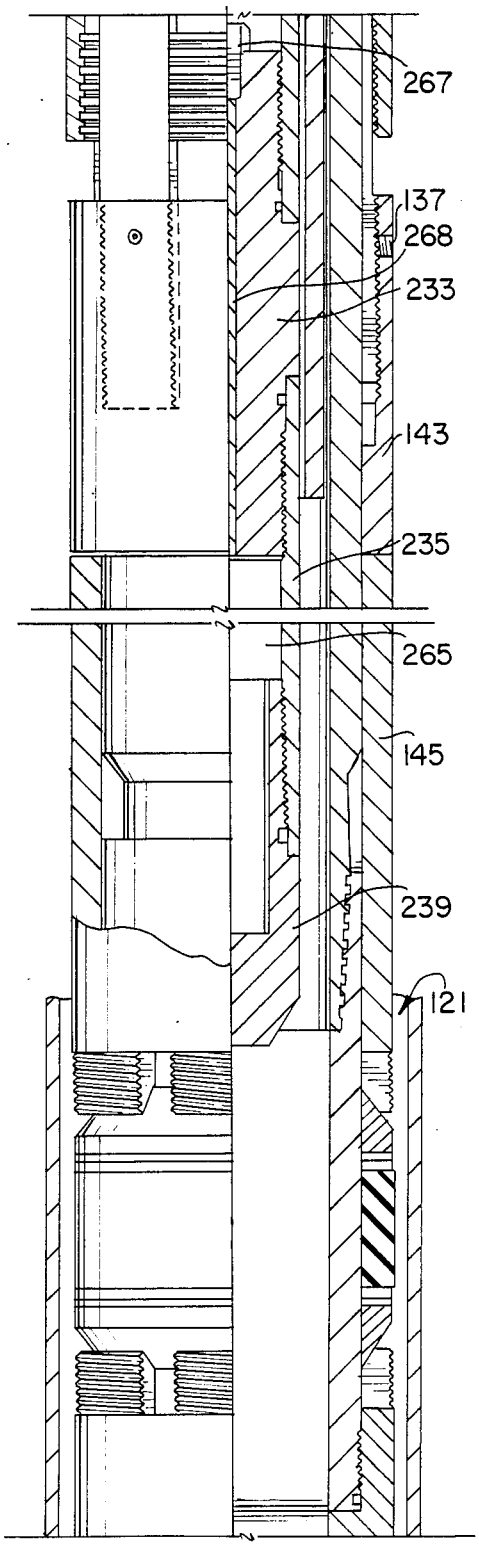

Referring now to FIGS. 17A–B, therein is shown a packer setting tool 220 operable by an alternative embodiment of an atmospheric chamber actuator 222. Setting tool 220 is identical to setting tool 120 discussed earlier herein with the exceptions that the inner mandrel, indicated as 124', now includes a seating surface 224 and an inwardly extending sealing surface 226; and in that a new port 223 has been added in a central location in second sealing surface 226. The remaining components of setting tool 220 are constructed and function identically to those in setting tool 120 and are similarly numbered.

Air chamber actuator 222 includes a housing 228 which is again adapted to withstand the hydrostatic pressures in the borehole. To facilitate assembly, housing 228 will preferably be composed of a plurality of sections 230, 231, 232 233, 235 and 239. Housing 228 will preferably have an upper portion of a first diameter, indicated generally at 234, and a lower portion of a second, smaller diameter indicated generally at 236. The diameter of upper portion 234 is proximate the inner diameter of seating surface 224 of inner mandrel 124' but will allow the flow of fluid between housing 228 and inner mandrel 124'. The diameter of second portion 236 is proximate the inner diameter of second seal portion 226 of inner mandrel 124'. The transition from first portion 234 to second portion 236 forms a ledge 237 adapted to engage an upper surface 238 of second sealing portion 226 of inner mandrel 124'. Housing 228 includes a recess 240 formed along the diameter of portion 236. A plurality of seals, indicated generally at 242, are retained within recess 240. Seals 242 are preferably chevron seals cooperatively arranged to prevent the flow of hydrostatic pressure into aperture 244 in housing 228 when seals 242 are engaged with sealing surface 226 of inner mandrel 124', as illustrated.

Housing 228 includes at least one passageway 246 which will extend from a position beneath second sealing portion 226 on inner mandrel 124' to a position above second sealing surface 226 when atmospheric chamber actuator 222 is positioned within setting tool 220. Passageway 246 assures that actuator 222 will not be prevented from seating within setting tool 220 because of fluid pressure trapped beneath actuator 222.

Located within housing 228 is a piston 250. Piston 250 is secured in position relative to housing 228 by one or more shear pins 252. The shear value of shear pins 252 will again establish the actuating pressure for actuator 222 and will be established at some margin of safety over the hydrostatic pressure at the depth of actuator 222. Upper surface 254 of piston 250 will be exposed to hydrostatic pressure through ports 235 in housing 228. Piston 250 includes an extension 256 which terminates in sealing portion 258. Sealing portion 258 includes a pair of seals **260*a*, 260*b* which straddle port 244 in housing 228 to prevent fluid flow therethrough. Sealing portion 258 is preferably of an enlarged diameter relative to the diameter of extension 256, such that when sealing portion 258 is moved downwardly past port 244, fluid may readily flow through port 244**.

Housing 228 includes a plurality of chambers 262, 263, 264, and 265. A damping piston 266 divides chamber 263 from chamber 264. A check valve 267 is installed in passage 268 between chamber 264 and chamber 265. In response to pressure in chamber 263 acting upon damping piston 266, damping piston 266 will push fluid in chamber 264 through the restriction of check valve 267 and passageway 268 into chamber 265, thereby slowing the transfer of fluid. As with the previously described embodiment of an atmospheric chamber actuator, the action of damping piston 266 on fluid chamber 264 serves to prevent setting tool 220 from operating too abruptly.

Figure 18A:
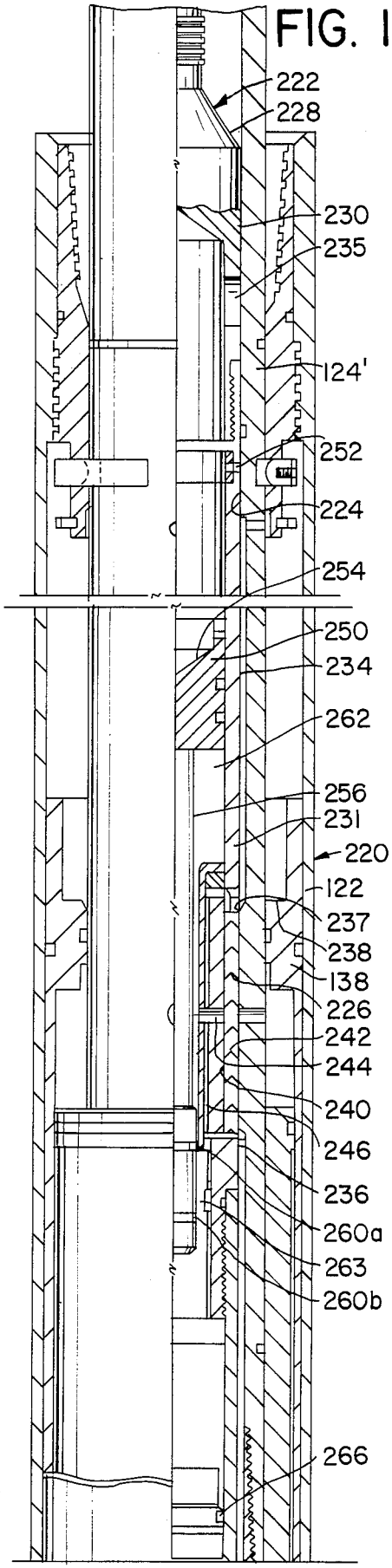
FIGS. 18A–B depict the apparatus of FIG. 17 after the atmospheric chamber actuator has been activated to operate the setting tool and set the packer, illustrated partially in cut away view and partially in vertical section.
Figure 18B:
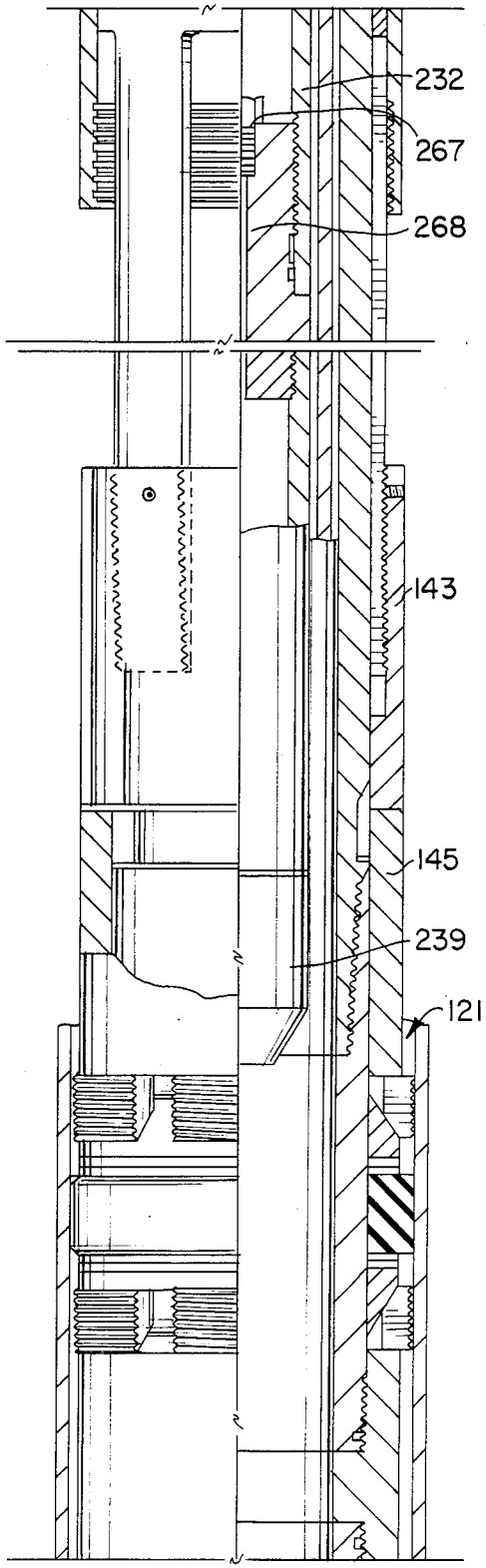

Referring now also to FIGS. 18A–B, therein is shown packer setting tool 220 after atmospheric chamber actuator 222 has been activated to cause setting tool 220 to set packer 121. Once the activating pressure is established within the tubing string, shear pins 252 will shear, and piston 250 will be driven downwardly. The downward movement of piston 250 removes sealing portion 258 from proximate port 244, exposing piston 52 within setting tool 220 to the low pressure within chamber 235. This low pressure causes piston 138 to move downwardly and set packer 121 in the manner described earlier herein.

Figure 19A:
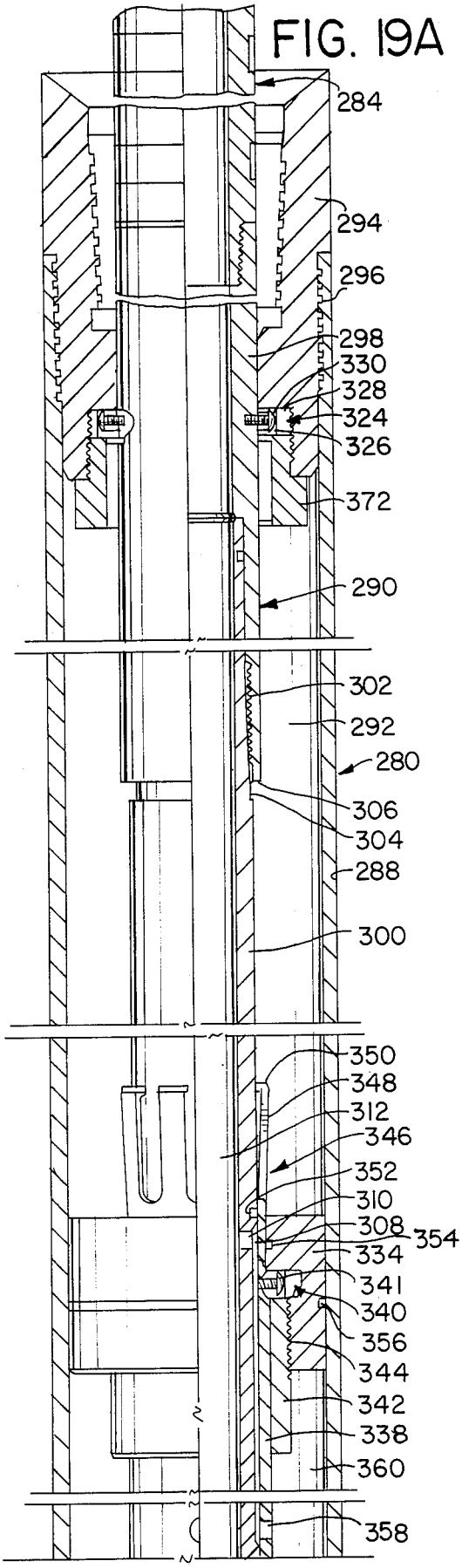
FIGS. 19A–B depict a dual-acting setting tool in accordance with the present invention, with an associated seal assembly and packer, depicted partially in a cut away view and partially in vertical section.
Figure 19B:
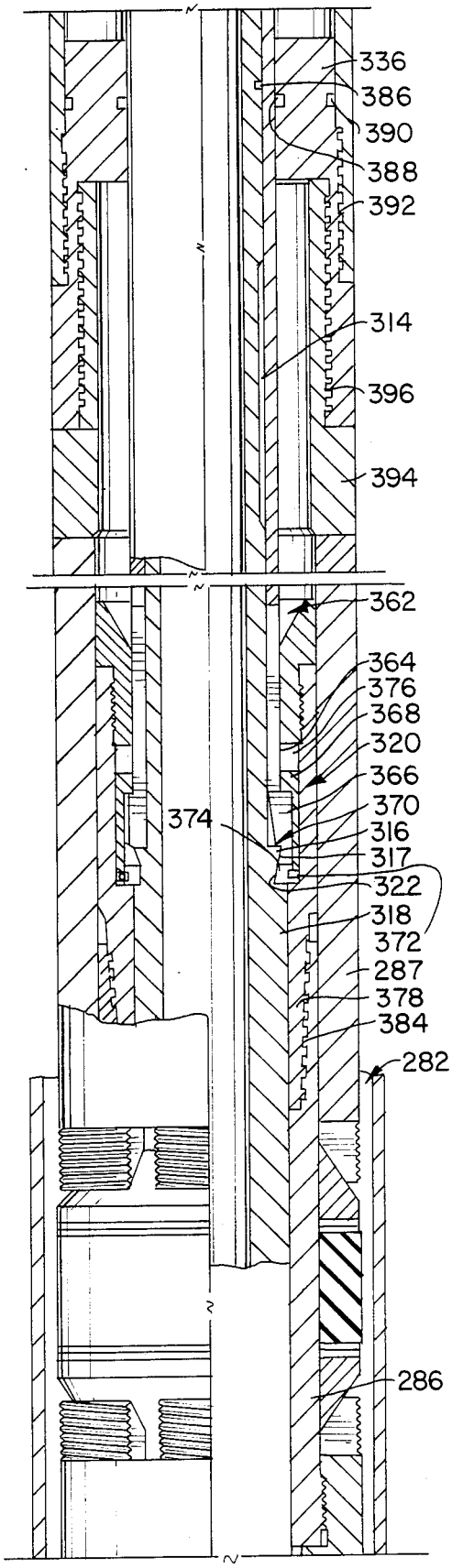

Referring now to FIG. 19A–B, therein is shown a dual-acting setting tool 280 for setting a packer 282. Setting tool 280 is again adapted to facilitate the placement of a seal assembly, indicated generally at 284, in the packer bore on a single trip into the well. Dual-acting setting tool 280 preferably applies setting force to both the packer body 286 and packer setting sleeve 287 to facilitate the setting of packer 282 without any movement of the tubing string as is typically required with conventional setting tools and/or hydraulically set packers.

Setting tool 280 includes a housing 288 and an inner mandrel assembly, indicated generally at 290, defining an annular chamber 292. Chamber 292 is closed at an upper end by endcap 294, threadably coupled, at 296, to housing 288. Inner mandrel assembly 290 includes a first member 298 threadably coupled, at 302, to a second member 300. First and second members 298, 300 are cooperatively conformed such that, at threaded coupling 302, a recess 304 is formed in inner mandrel 290 with a ledge 306 defining the upper edge of recess 304. Second member 300 includes a first, external, longitudinally extending recess 308 and at least one port 310 which provides fluid communication between central annulus 312 in inner mandrel 290 and recess 308. Longitudinally spaced from first external recess 208 is a second, external, longitudinal extending recess 314, the function of which will be described in more detail later herein.

Figure 20:
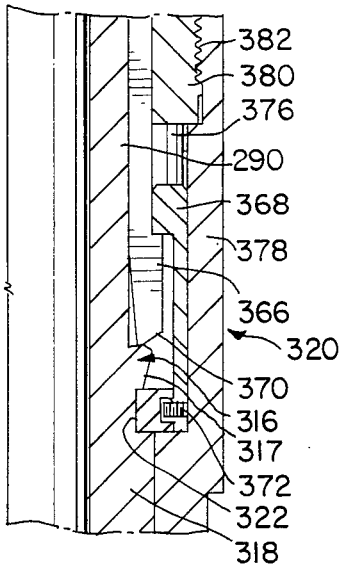
FIG. 20 depicts the lower latch mechanism of the setting tool of FIG. 19 in greater detail, illustrated in vertical section.

Referring now also to FIG. 20, longitudinally spaced from second external recess 314, inner mandrel 290 includes a projecting flange 316 and a portion of enlarged diameter 318 which function as components of a lower latching mechanism, indicated generally at 320. Flange 316 has a maximum diameter equal to the diameter of enlarged portion 318. Latching mechanism 320 is conformed such that flange 316 includes a tapered surface 317 on its lower side, and a recess 322 is formed between the lower end of flange 316 and enlarged portion 318. The remainder of latching mechanism 320 will be discussed in more detail later herein.

Figure 21:
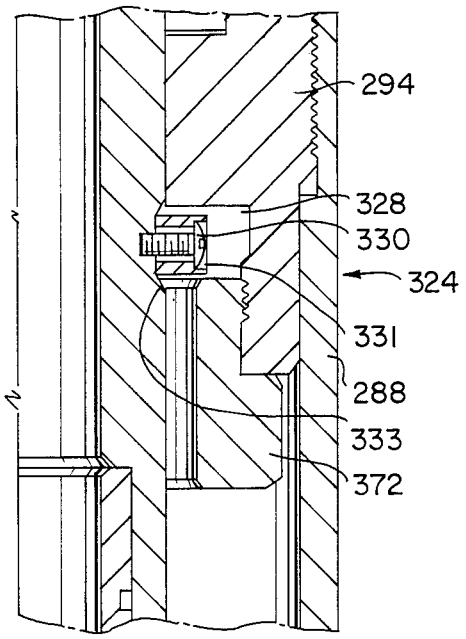
FIG. 21 depicts the upper latch mechanism of the setting tool of FIG. 19 in greater detail, illustrated in vertical section.

Referring now also to FIG. 21, inner mandrel 290 is secured in fixed relation to housing 288 and endcap 294 by an upper shearable latch assembly, indicated generally at 324. Latch assembly 324 includes a C-shaped ring 326 within a recess 328 between inner mandrel 290 and endcap 294. A cap 372 secures C-shaped ring 326 in fixed relation to endcap 294. C-shaped ring 326 is preferably formed of a resilient metal and has a nominal external diameter which is preferably at least as large as the maximum diameter in recess 328. C-shaped ring 326 is secured to inner mandrel 290 by a plurality of shear screws 330. The caps of shear screws 330 may be housed within an external recess 331, or in individual countersinks, in C-shaped ring 326. As shear screws 330 are threaded into inner mandrel 290, shear screws 330 compress the diameter of C-shaped ring 326. A small recess 333, such as one-sixteenth of an inch, is formed in inner mandrel 290 proximate the area in which shear screws 330 threadably couple to inner mandrel 290. As will be discussed later herein, when shear screws 330 shear, the resiliency of compressed C-shaped ring 326 will force one end of shear screws 330 away from inner mandrel 290. Additionally, the other end of sheared shear screws 330 is recessed within recess 312. Accordingly, each shear surface of shear screws 330 is removed from an adjacent surface, thereby preventing subsequent damage to either the packer bore or the exterior of seal assembly 284.

Located within chamber 292 are a first piston 334 and a second piston 336. A packer actuating sleeve 338 is coupled to first piston 334 by a shearable latch mechanism, indicated generally at 340. Shearable latch mechanism 340 is preferably generally of a type as described earlier herein for shearable latch 324. Shear screws 341 in shearable latch 340 will require a higher shear force than shear screws 330 in shearable latch 340. Shearable latch 340 secures piston 334 to actuating sleeve 338 through use of a backup collar 342 threadably coupled, at 344, to piston 334.

Actuating sleeve 338 includes an upper portion, indicated generally at 346, which includes a plurality of collet fingers 348. Collet fingers 348 have inwardly projecting tips 350 adapted to be engageable with notch 304 in inner mandrel 290. A plurality of seals 352 and 354 seal between inner mandrel 290 and actuating sleeve 338, and between actuating sleeve 338 and first piston 334, respectively. Another seal 356 seals between piston 334 and housing 288. Actuating sleeve 338 includes a port 358 which allows fluid communication between first external recess 308 in mandrel 280 and a chamber 360 between first piston 334 and second piston 336. A seal 386 between actuating sleeve 338 and inner mandrel 290 cooperatively serves with seal 352 to isolate any fluid in recess 308 from either chamber 292 or chamber 360. A pair of seals 388 and 390 seal between second piston 336 and actuating sleeve 338 and housing 288.

The lower end 362 of actuating sleeve 338 includes a plurality of collet fingers 364. As seen in detail in FIG. 20, collet fingers 364 include outwardly projecting flanges 366 engageable with slidable member 368 in latch mechanism 320. The lower-most portion of each collet finger 362 includes an upwardly tapered surface 370. Slidable member 368 is secured by a plurality of shear screws 372 to a C-shaped ring 374. C-shaped ring 374 is preferably sized to require some slight compression to fit within recess 376 formed between packer actuating sleeve 378 and inner mandrel 290. Slidable member 368 is retained within recess 376 by cap 380 threadably coupled, at 382, to packer actuating sleeve 378. Latch mechanism 320 secures packer actuating sleeve 378, actuating sleeve 338, and inner mandrel 290 in a releasable, fixed relation to one another. Packer actuating sleeve 378 contains a plurality of threads 384 adapted to mate with packer body 286.

Second piston 336 in chamber 292 is threadably coupled, at 392, to housing 288. An adjustment sleeve 394 is threadably coupled, at 396, to second piston 336. Adjustment sleeve 394 will directly contact upper actuating sleeve 287 of packer 282. Threaded coupling 396 facilitates the adaptation of setting tool 282 to different packers or to packers having variances in actuating sleeve lengths.

Inner mandrel 290 will typically have a ported extension (not illustrated) attached to its lower end, as illustrated with hydraulically set packer 22 of FIGS. 1–8. As shown in FIG. 2, this ported extension will preferably include a shoulder for receiving a sealing ball to facilitate the establishing of pressure in central passageway 312 of inner mandrel 290.

Figure 22A:
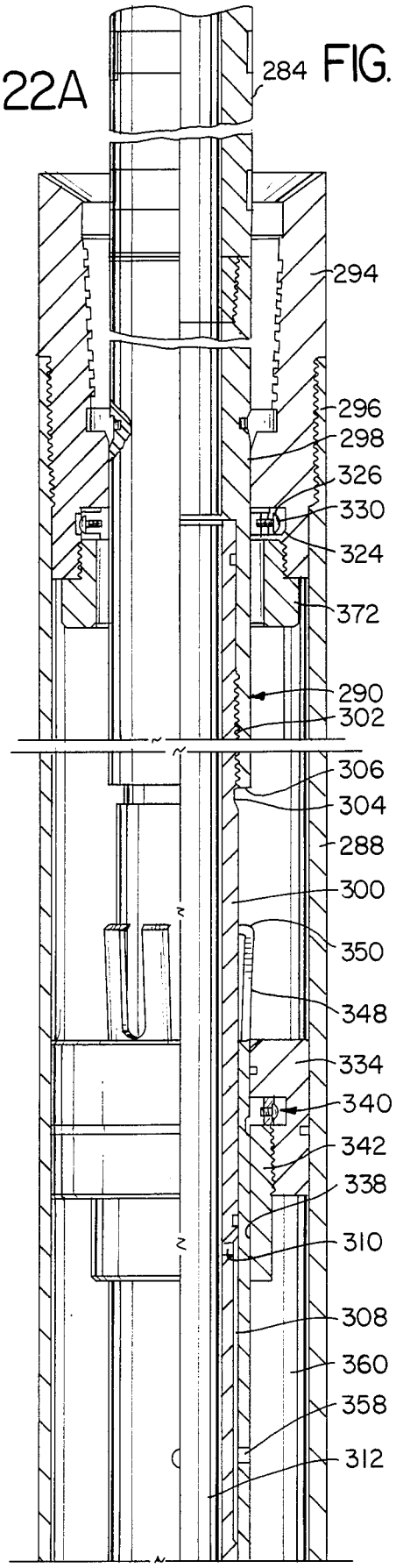
FIG. 22A–B depicts the apparatus of FIG. 19 after the setting tool has been activated to set the packer, illustrated partially in a cut away view and partially in vertical section.
Figure 22B:
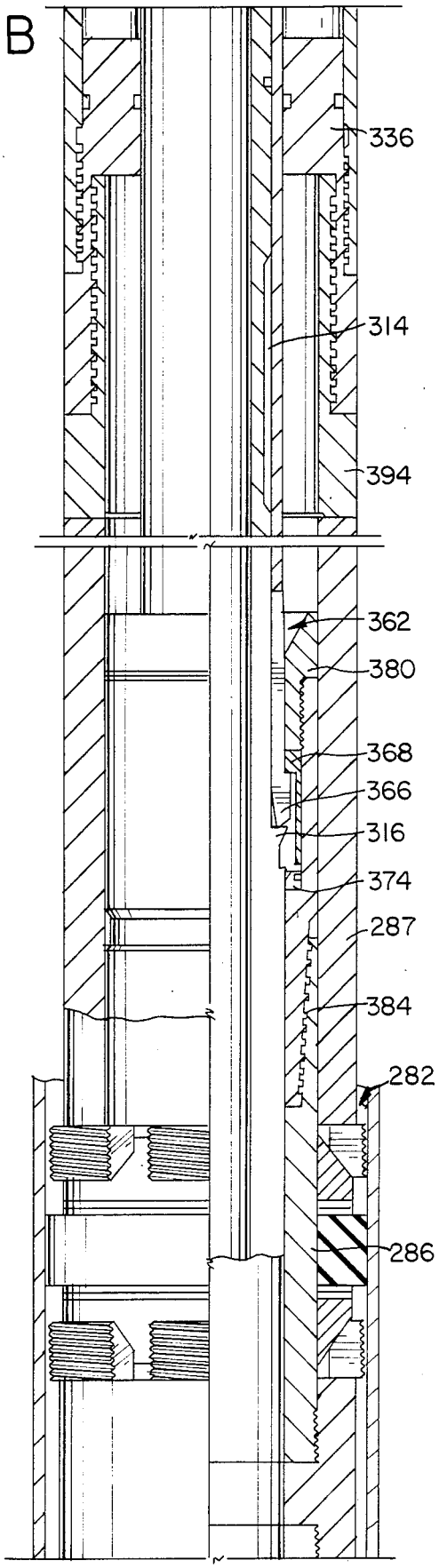

Referring now also to FIGS. 22A–B, therein is shown dual-acting setting tool 280 after it has been activated to set packer 282. As indicated above, setting tool 280 activates in response to fluid pressure within central passageway 312.

Fluid pressure in central passageway 312 will be applied to first and second pistons 334, 336 by way of port 352 in inner mandrel 290, external recess 308 and port 358 into chamber 360. Setting tool 280 is designed such that first piston 334 will be utilized to initially set the lower slips of packer 282. The activation pressure for movement of first piston 334 will be determined by the shear strength of shear screws 372 in latching mechanism 320. Pressure on first piston 334 will be applied through actuating sleeve 338, including flanges 336, to sliding sleeve 368. When the initial actuating pressure is reached, shear screws 372 will shear, allowing slidable member 368 to move upwardly to contact endcap 380. The upward movement of piston 334 will then be transferred through endcap 380 to packer mounting sleeve 384, pulling upwardly on the body of packer 282 and causing the initial setting of lower slips 400 of packer 282.

Setting tool 280 is designed such that a further increase in pressure will cause the release of latching mechanism 324 securing inner mandrel 290 in fixed relation to housing 288. The pressure applied in chamber 360 will also act upon second piston 336 which is acting, through housing 288 and endcap 294 on latching mechanism 324. When the shear strength of shear screws 330 is reached, latching mechanism 324 will release as described earlier herein, and second piston 336 will cause adjustment sleeve 394 to push against packer actuating sleeve 398 and set upper slips 402 of packer 282. Pressure will continue to be applied in central passageway 312 until packer 282 is fully set.

Figure 24:
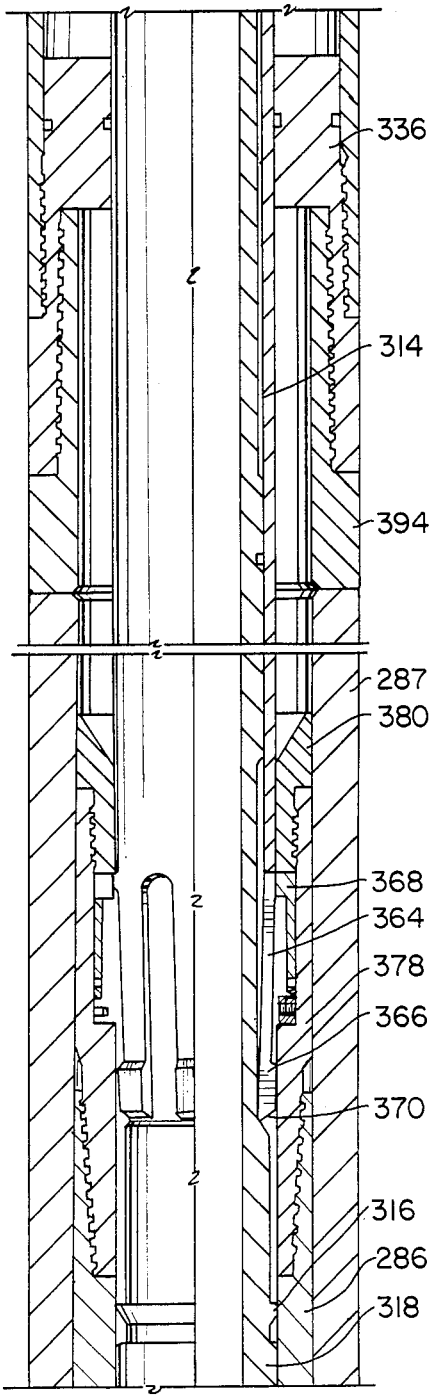
FIG. 24 depicts the apparatus of FIG. 19 after the tubing string has been manipulated to lower the seal assembly toward the packer bore, illustrated in vertical section.
Figure 23:
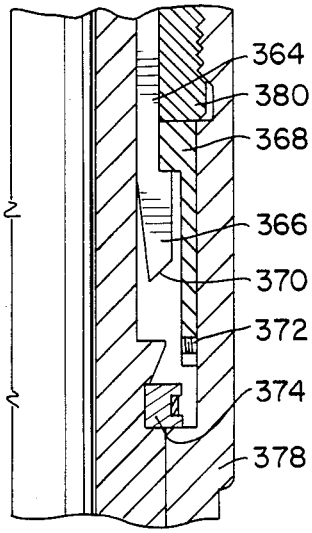
FIG. 23 depicts the lower latching mechanism of the apparatus of FIG. 19 after release, in greater detail, illustrated in vertical section.
Figure 25:
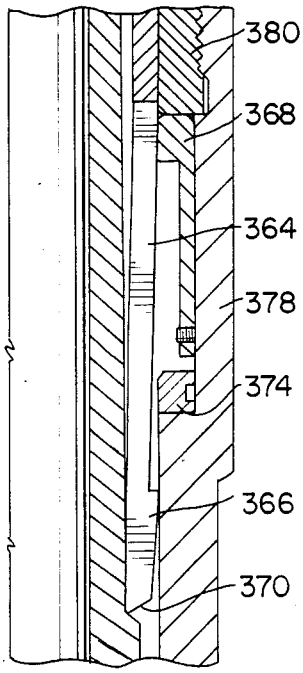
FIG. 25 depicts the lower latching mechanism of FIG. 24 after the tubing string has been manipulated to lower the seal assembly toward the packer bore in greater detail, illustrated in vertical section.

Referring now also to FIGS. 24 and 25, once packer 282 has been set, seal assembly 284 may be lowered into place within the packer bore as desired. After setting of packer 282, pressure will continue to be applied in central passageway 312 until a final threshold pressure is achieved which shears shear screws 341 and releases latch mechanism 340 coupling piston 334 to actuating sleeve 338. Upon this shearing, piston 334 will move up only slightly due to the constriction provided by collet fingers 346. Inner mandrel 290 and attached seal assembly 284 may then be lowered relative to housing 288 and packer 282. As inner mandrel 290 is lowered, it will slide along actuating sleeve 338. When second external recess 314 comes proximate lower collet fingers 364, lower surface 370 of collet fingers 364 will urge C-shaped ring 374 outwardly and collet fingers 364 will fit into external recess 314. Simultaneously, inwardly projecting flanges 350 of upper collet fingers 346 will snap into notch 304 in inner mandrel 290. From such point on, inner mandrel 290 and actuating sleeve 338 will move downwardly as a unit, allowing production seals 284 to be placed in their desired position in the bore of packer 282.

Figure 26A:
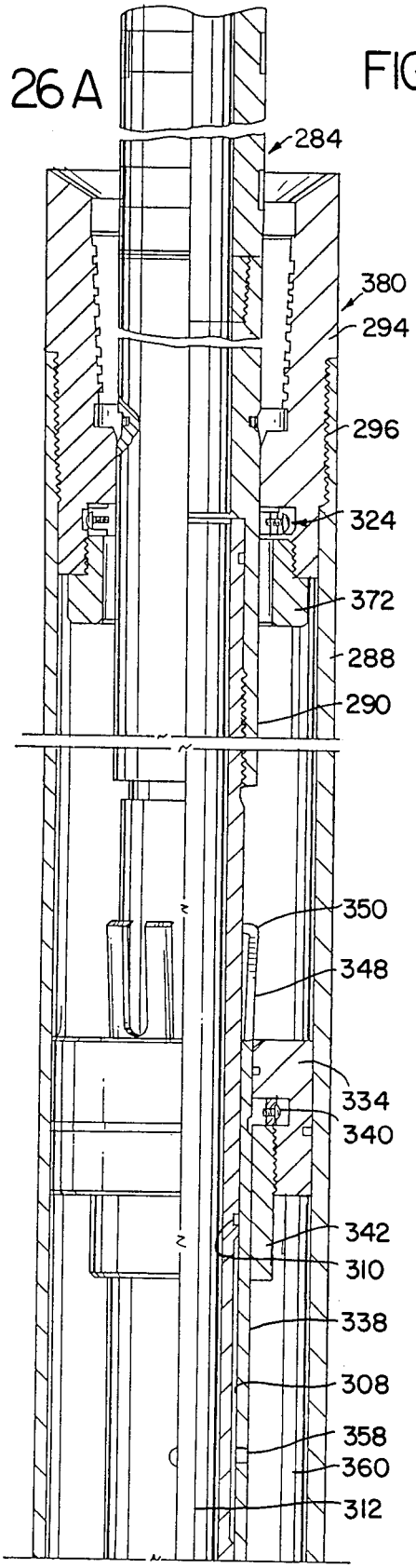
FIGS. 26A–B depict a dual-acting hydrualically set packer in accordance with the present invention, depicted in half vertical section.
Figure 26B:
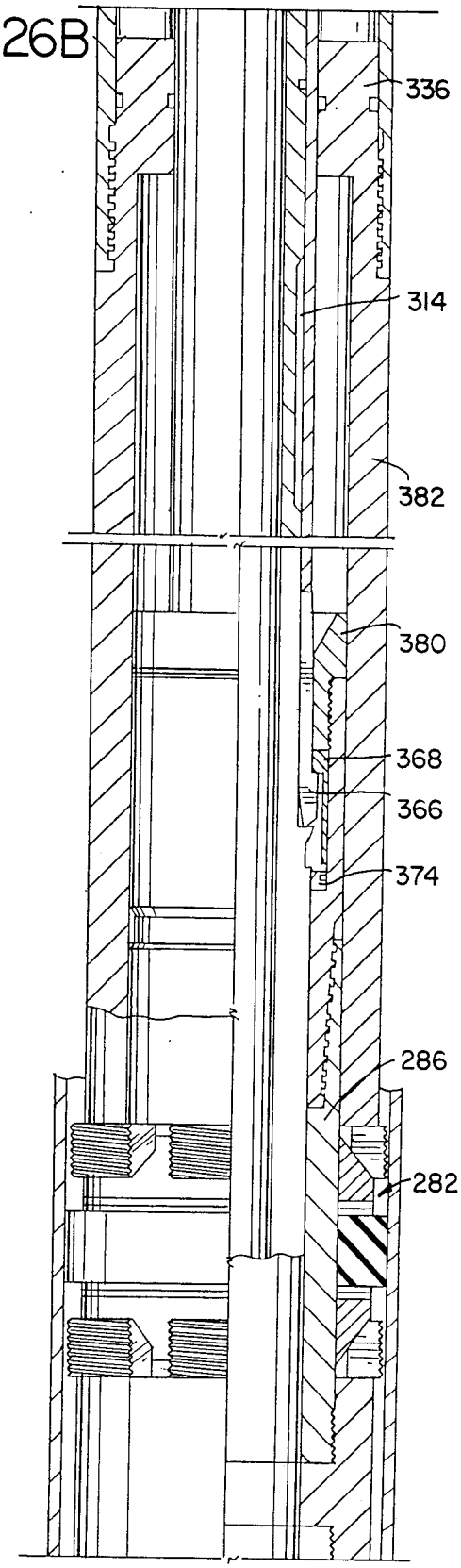

Referring now to FIGS. 26A–B, therein is shown a dual-acting hydraulically set packer 380. Dual-acting hydraulically set packer 380 is identical to the combination of dual-acting setting tool 280 and packer 282, with the exception that adjustment sleeve 394 is no longer necessary, and the second piston (336 in FIG. 19B) and packer actuating sleeve (398 in FIG. 19B) are now combined as a single member, as indicated at 382. FIGS. 26A–B illustrate hydraulically set packer 380 after the packer has been set, but prior to the lowering of the seal assembly 284, into the packer bore. The remaining components in dual-acting hydraulically set packer 380 are constructed and function identically to corresponding components discussed in reference to dual-acting setting tool 280 and packer 282 in FIGS. 19–25. Accordingly, the remaining components have been similarly numbered, and the operation of packer 380 may be determined by reference to the discussion concerning FIGS. 19–25.

Figure 27A:
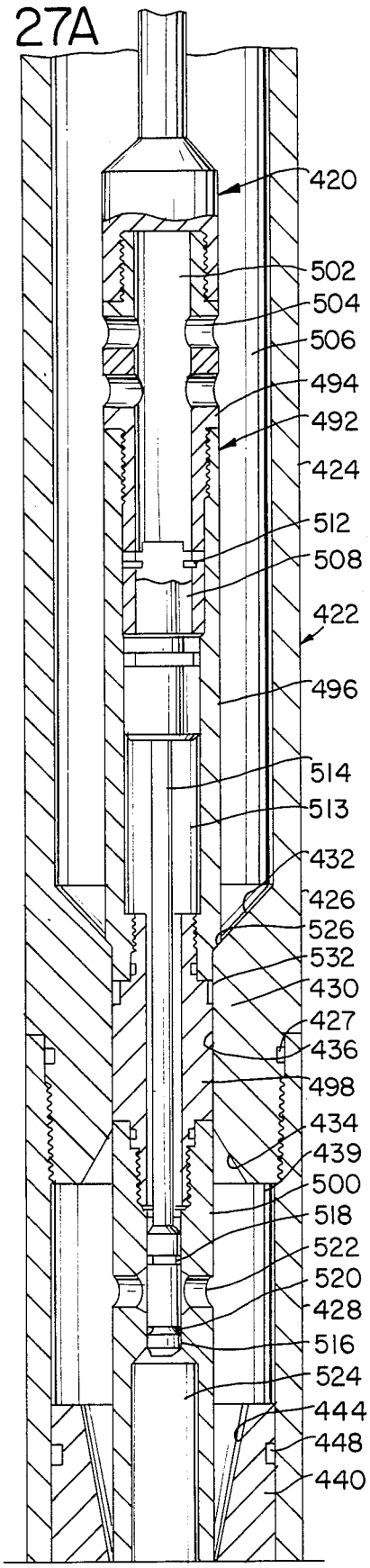
FIGS. 27A–B depict a firing head and an atmospheric chamber actuator for operating such firing head in accordance with the present invention, illustrated substantially in vertical section.
Figure 27B:
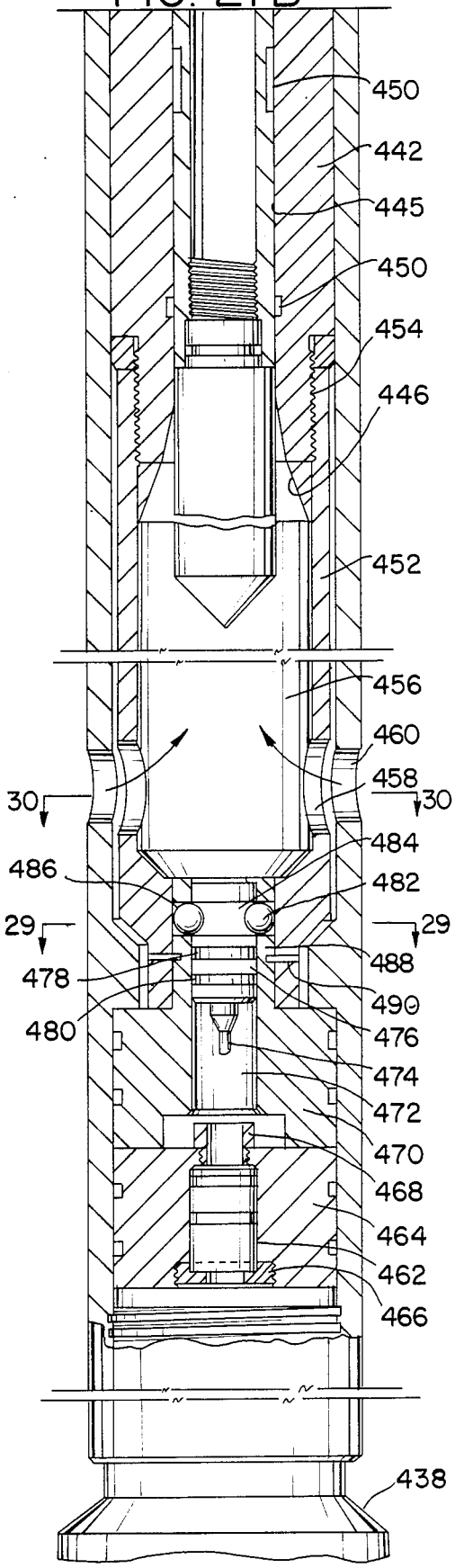

Referring now to FIGS. 27A–B, therein is illustrated an alternative embodiment of an atmospheric chamber actuator 420 in operating position with a slidable sleeve mechanism, in this example a perforating gun firing head 422. As with the previously described atmospheric chamber actuators, atmospheric chamber actuator 420 is designed to utilize a relatively minor increase in pressure over hydrostatic pressure to activate the actuator and to allow the preexisting hydrostatic pressure to operate firing head 422.

Firing head 422 includes a housing 424. Housing 424 will preferably be formed of at least two parts, an upper member 426 and a lower member 428. Housing 424 will typically couple directly to the tubing string or to a similar member, such as a tubular extension, as illustrated at 39 in FIG. 2. Upper member 426 includes a central sealing portion 430 of reduced diameter. Upper and lower surfaces, 432 and 434, respectively, of central sealing portion 430 and preferably tapered toward a central sealing surface 436.

Lower member 428 couples at a first end to upper member 426. A seal 427 such as a conventional O-ring seal is utilized to seal between upper and lower member 426 and 428. Lower member 428 will typically be coupled at a lower end to perforating gun 438. Housed within lower member 428 is a piston 440. Piston 440 includes a central sealing portion 442 of reduced diameter. Upper and lower surfaces 444 and 446, respectively, of central sealing portion 442 are preferably inwardly tapered toward a central sealing surface 445. A first seal 448 seals between piston 440 and housing 428 while a second seal 450 will seal between piston 440 and atmospheric chamber actuator 422 when atmospheric chamber actuator 422 is positioned within firing head 422, as illustrated in FIG. 27. Second seal 450 will preferably be a bonded seal or an appropriately arranged set of chevron seals.

An actuating sleeve 452 is threadably coupled, at 454, to piston 440. Actuating sleeve 452 defines a chamber 456. A plurality of ports 458 in actuating sleeve 452 align with similar ports 460 in housing 424 to provide fluid communication between chamber 456 and the borehole annulus surrounding firing head 422.

Figure 30:
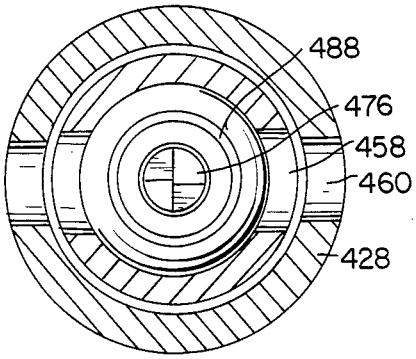
FIG. 30 depicts the firing head of FIG. 27 in horizontal section along lines 30—30 in FIG. 27.
Figure 28:
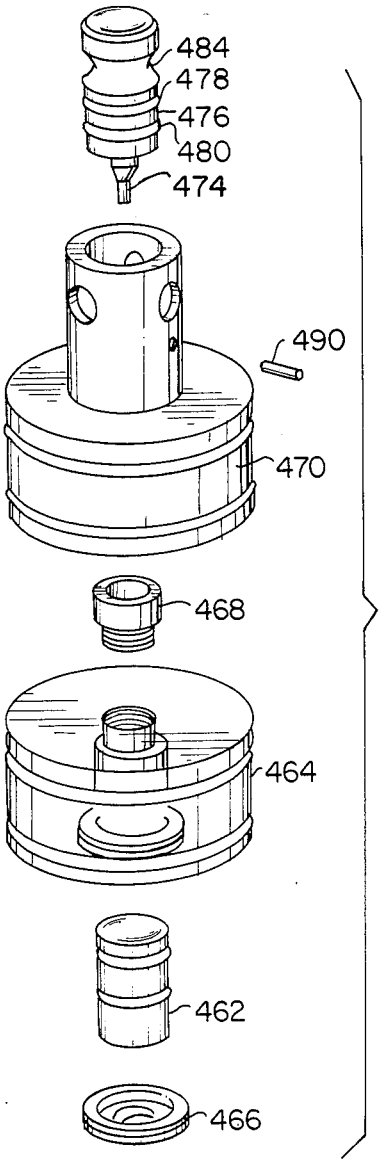
FIG. 28 depicts the detonation components of firing head of FIG. 27, illustrated in an exploded perspective view.
Figure 29:
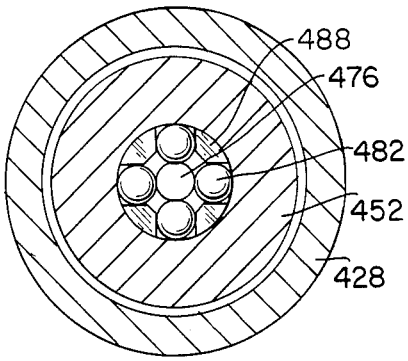
FIG. 29 depicts the firing head of FIG. 27 in horizontal section along lines 29—29 in FIG. 27.

Referring now also to FIGS. 28–30, the lower end of housing 424 includes a detonating charge 462 retained within a charge holder 464. A pair of threaded caps 466 and 468 are utilized on opposite sides of detonating charge 462 to secure charge 462 in position. A firing pin retainer 470 is held in housing 424 above charge holder 426. Firing pin retainer 470 includes a central bore 472 which houses a firing pin 474 mounted on a piston 476. Piston 476 is sealingly engaged, by means of seals 478 and 480, within bore 472. Firing pin piston 476 is secured in fixed relation to firing pin retainer 470 by a plurality of retaining balls 482 which engage a peripheral recess 484 in piston 476 and a plurality of apertures 486 in an upper portion 488 of firing pin retainer 470. Retaining balls 482 are secured in position by the slidable engagement of actuating sleeve 452 over upper portion 488 of firing pin retainer 470. Actuating sleeve 452 is secured in position over upper portion 488 of firing pin retainer 470 by a plurality of shear pins 490. Shear pins 490 will be selected to shear at a pressure less than the hydrostatic pressure within the well.

Air chamber actuator 420 includes a housing 492 which will typically include a plurality of members, as illustrated at 494, 496, 498, and 500. Housing 492 includes an upper chamber 502 in fluid communication, through ports 504, with tubing annulus 506. A piston 508 is slidably and sealingly engaged within housing 492. Piston 508 will initially be retained in a first position relative to housing 492 by shear pins 512. Piston 508 includes a longitudinal extension 514 and a sealing portion 516. Sealing portion 516 includes a plurality of seals 518, 520 which straddle apertures 522 in housing 492. Sealing portion 522 terminates above a fluid chamber 524 in the lower end of housing 492. External hydrostatic pressures are sealed from chambers 513 and 524. Chambers 513 and 524 of atmospheric chamber actuator 520 will therefore be at atmospheric pressure.

As can be seen in FIGS. 27A–B atmospheric chamber actuator housing 492 includes a ledge 526 adapted to engage upper surface 432 of sealing portion 430 of firing head housing 424. When atmospheric chamber actuator 492 is lowered into position in firing head 522, a seal 532 forms a fluid-tight seal between atmospheric chamber actuator housing 492 and sealing surface 436 of firing head housing 424. Seal 532 will again preferably be either a bonded seal or an appropriately arranged set of chevron seals. Similarly, seal 450 in firing pin piston 440 forms a fluid-tight seal with the lower portion of atmospheric chamber actuator housing 492. Seals 432 and 450 thereby isolate chamber 439 in firing head 492 from hydrostatic pressure.

Figure 31A:
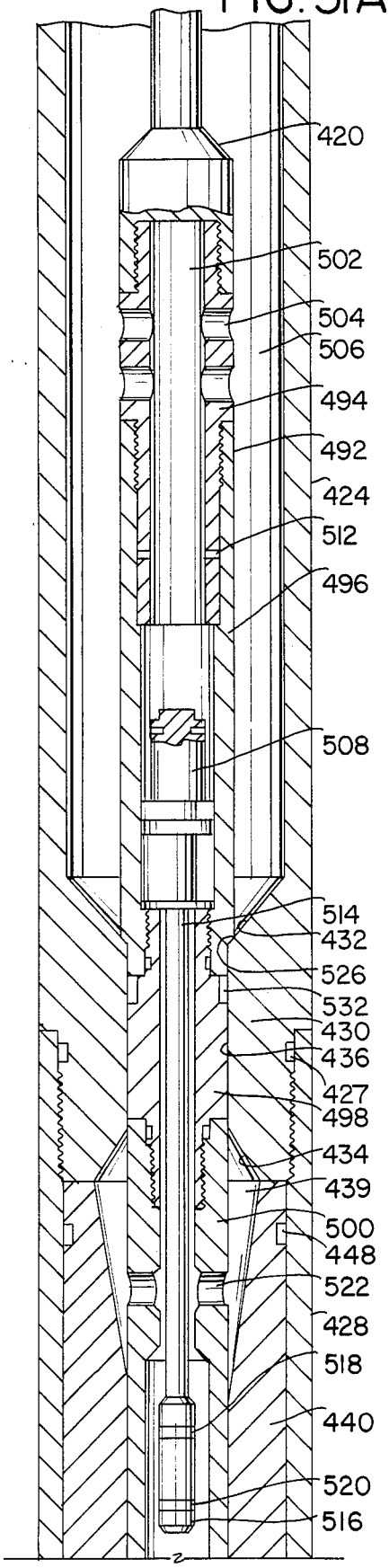
FIGS. 31A–B depict the apparatus of FIG. 27 after the atmospheric chamber actuator has been activated to operate the firing head, illustrated substantially in vertical section.
Figure 31B:
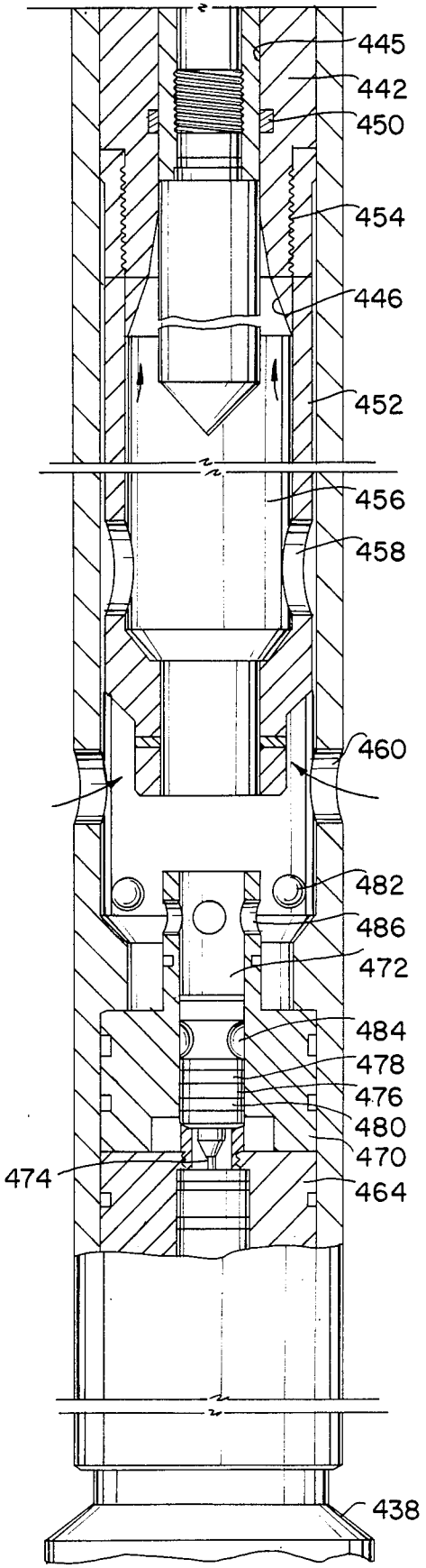

Referring now to FIGS. 31A–B, therein is shown firing head 422 after it has been activated through operation of atmospheric chamber actuator 420. In operation of inner chamber actuator 420, a predetermined fluid pressure is established within tubing annulus 506. This fluid pressure passes through ports 504 and acts upon top surface 534 of piston 508. When the preestablished pressure is reached, shear pins 512 shear, and piston 508 is driven downwardly. Downward movement of piston 508 removes sealing portion 516 from proximate apertures 522 in housing 492, thereby placing chamber 524, which is at atmospheric pressure, in fluid communication with chamber 439 in firing head 422.

This low pressure in chamber 439 allows hydrostatic pressure in chamber 456 to operate against the lower end of piston 440 and actuating sleeve 452. The hydrostatic pressure shears shear pins 490 drives both members upward relative to housing 424 and actuator 420 until the upper end of piston 440 contacts the lower end of upper member 426, removing actuating sleeve from its concentric relation to upper portion 488 of firing pin retainer 470. Once actuating sleeve is removed from proximate upper portion 488 of firing pin retainer 470, retainer balls 482 move out of recess 484 and the hydrostatic pressure drives the firing pin piston 476 and firing pin 474 downwardly to detonate detonating charge 462, thereby detonating perforating gun 438.

Figure 32A:
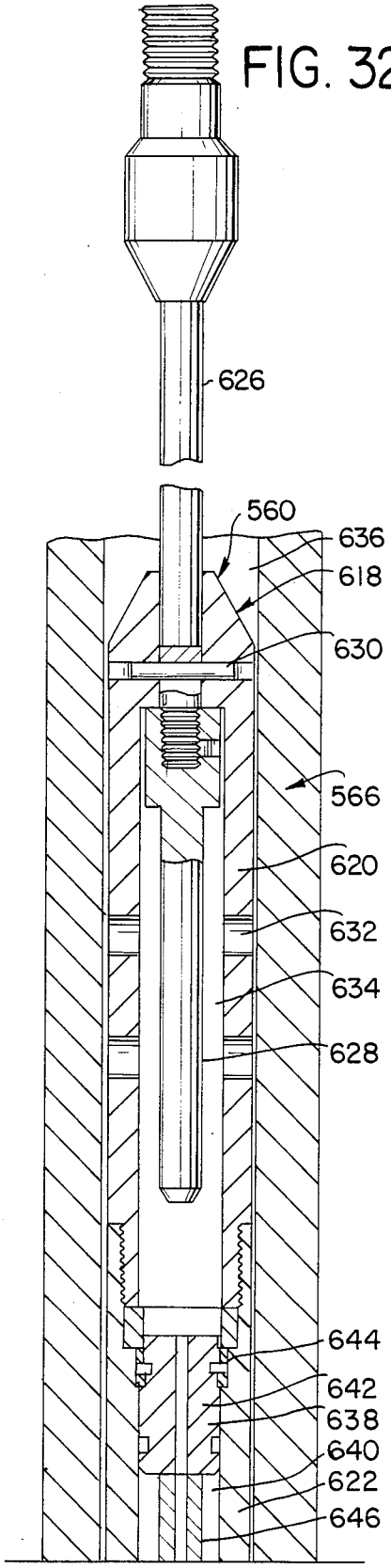
FIGS. 32A–C depict a tubing release sub with an alternative embodiment of an atmospheric chamber actuator for operating the tubing release sub in accordance with the present invention, depicted substantially in vertical section.
Figure 32B:
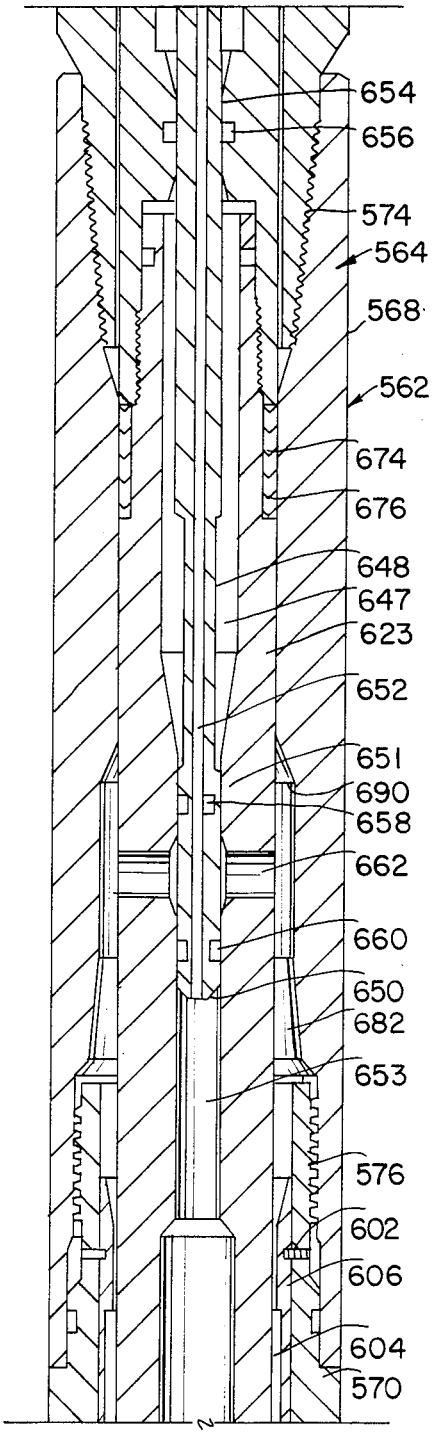
Figure 32C:
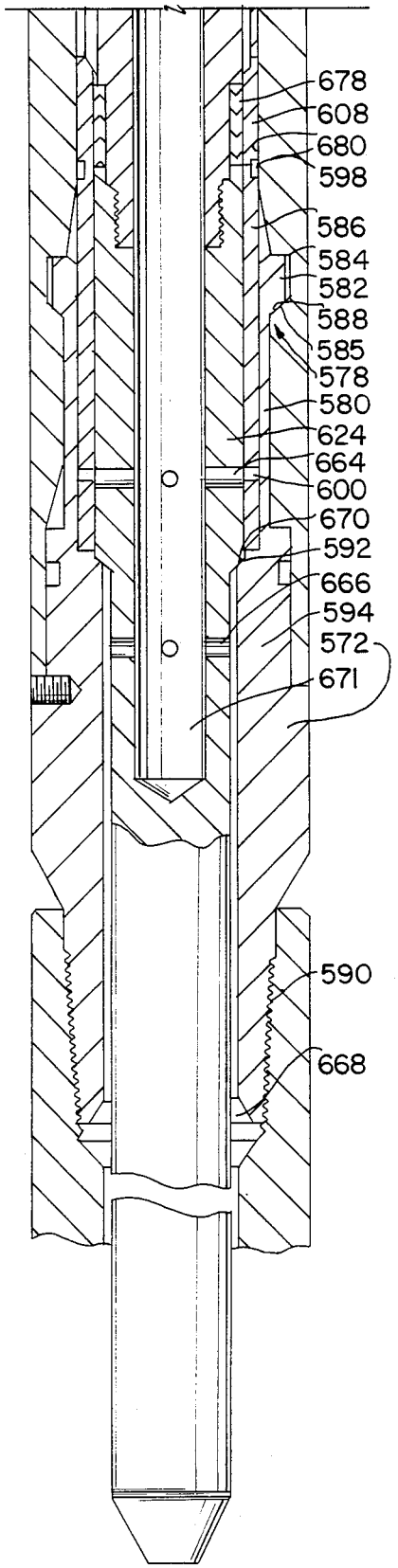

Referring now to FIGS. 32A–C, therein is shown another alternative embodiment of an atmospheric chamber actuator 560 in an operating configuraton with an alternative sliding sleeve mechanism, in this example a tubing release sub 562. Tubing release sub 562 is operable by means of a sliding sleeve mechanism. Those skilled in the art will recognize that several types of devices utilized in the oil and gas industry, such as, for example, tubing valves, or firing heads may be operable by sliding sleeve mechanism. Accordingly, the basic mechanism disclosed herein will be adaptable for use in such other devices.

Figure 33:
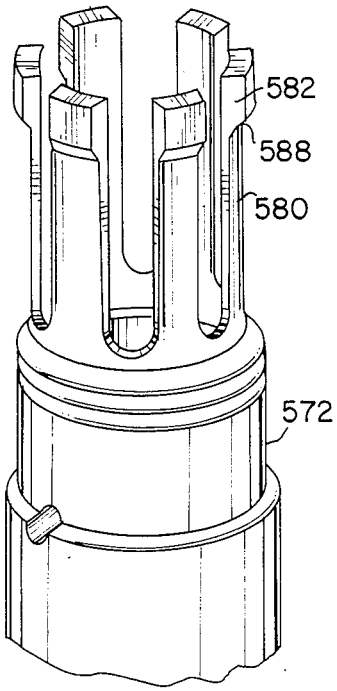
FIG. 33 depicts an upper portion of the lower housing member of tubing release sub of FIG. 32, illustrated in a partial perspective view.

Tubing release sub 562 includes a housing, indicated generally at 564. Housing 564 is preferably composed of three members, 568, 570 and 572. Top member 568 will be adapted to couple to the tubing string illustrated at 566. The lower end of member 568 is preferably coupled, at 576, to member 570. Member 570 is coupled to member 572 by means of a collet mechanism, indicated generally at 578. Lower member 572 includes a plurality of collet fingers 580, as can be seen in FIG. 33. Collet fingers 580 include outwardly extending lugs 582 which cooperatively engage recesses 584 in member 570. Collet fingers 580 are secured in engagement with notches 584 by the presence of a sliding sleeve 586. Lower surfaces 588 of lugs 582 and lower surface 585 of recesses 584 are each preferably downwardly tapered. The lower end of member 572 will typically include a pin connection 590 to facilitate attachment to a length of tubing or other device, such as a perforating gun, which is desired to be releasably coupled through tubing release sub 562. Lower member 572 includes an area of reduced diameter 594 and a ledge 592. Ledge 592 will receive shoulder 670 of atmospheric chamber actuator 560.

Sliding sleeve 586 includes a seal 598 which seals between sliding sleeve 586 and housing 564. Sliding sleeve 586 also includes a plurality of apertures 600. Additionally, sliding sleeve 568 includes an inner recess 604 between an upper portion 606 and a lower portion 608. The function of recess 604 will be discussed in more detail later herein. Sliding sleeve 586 is retained in an initial position relative to housing 564 by a plurality of shear pins 602.

Air chamber actuator 560 is designed to allow the operation of tubing release sub 562 purely in response to existing hydrostatic pressure in the well, and without the application of hydraulic pressure within the tubing string. Actuator 560 includes a housing 618, which for practical considerations may be formed from a plurality of members 620, 622, 623, and 624. Actuator 560 includes a striker bar 626 which includes a striking piston 628 contained within housing 618. Striker bar 626 is coupled to housing 618 by means of a shear pin 630. A plurality of ports 632 provide fluid communication between a chamber 634 in housing 618 and the tubing annulus 636.

A hydraulic piston 638 is slidably received within an inner bore 640 in housing 560. Piston 638 includes an upper portion 642. Upper portion 642 is coupled by shear pins 644 to a retainer ring 637 held in housing 560. Extending from first portion 642 of piston 638 is a first extension 646 of a first diameter and a second extension 648 of a second, smaller diameter. Second portion 648 ends in a sealing portion 650 having a diameter equal to first extension 646. First extension 646 passes through an inwardly projecting first sealing portion 654 in housing 560. A seal 656 seals between housing 560 and first extension 646.

Sealing portion 650 of piston 638 extends into a second sealing portion 651 in housing 560. Sealing portion 650 includes a pair of seals 658, 660 which straddle ports 662 in housing 560 when piston 638 is in an initial position, as illustrated. The dimensions of second sealing portion 561 are such that, regardless of the position of piston 638, sealing portion 650 will always seal within bore 653 of second sealing portion 561.

Housing 618 includes a plurality of ports 664 and 666 which provide fluid communication between lower annulus 668 and chamber 671 in housing 618. Piston 638 includes a central longitudinal aperture 652. Aperture 652 in piston 638 provides fluid communication between chambers 634 and 671 in housing 618. Air chamber actuator 560 includes a first set of seals 674 adapted to sealingly engage first sealing surface 676 in tubing release sub 562. Seals 674 are preferably a plurality of stacked chevron seals. Air chamber actuator 560 includes a second set of external seals 678 adapted to engage sliding sleeve 586. Seals 678 are also preferably stacked chevron seals. When inner chamber actuator 560 is inserted into tubing release sub 562 as illustrated in FIG. 30, seals 674 and 678 serve to isolate a chamber 682 from tubing annulus 636 and lower annulus 668.

Figure 34A:
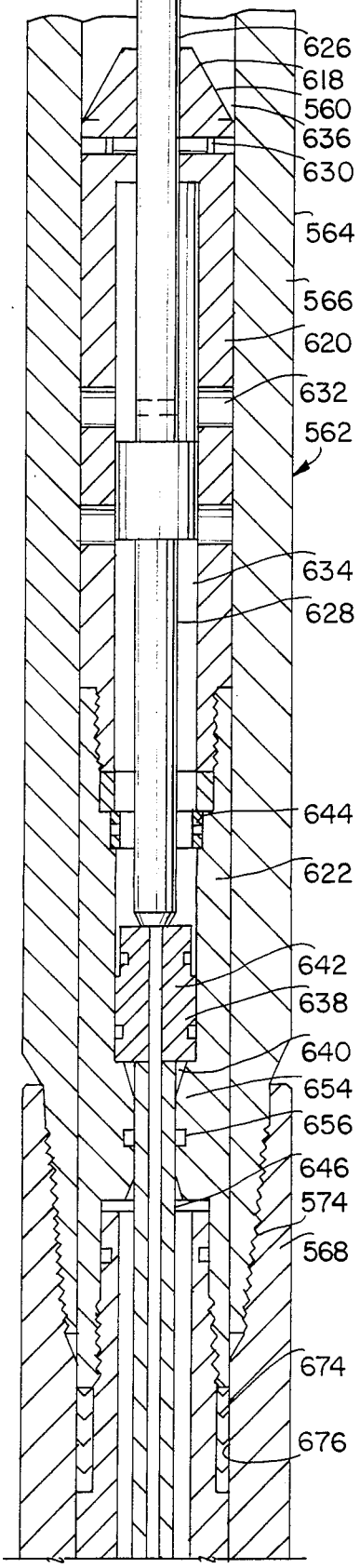
FIGS. 34A–B depict the apparatus of FIG. 32 after the atmospheric chamber actuator has been activated to operate the tubing release, illustrated in vertical section.
Figure 34B:
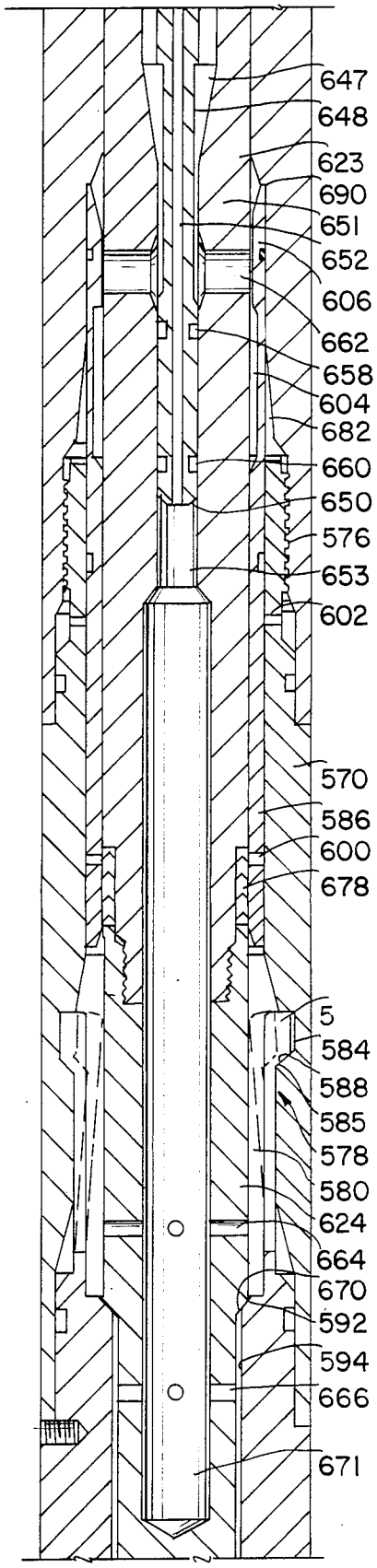

Referring now to FIGS. 34A–B, therein is shown atmospheric chamber actuator 560 and tubing release sub 562 after atmospheric chamber actuator 560 has been activated to operate tubing release sub 562. As discussed earlier herein, atmospheric chamber actuator 560 is operated in response to a shock applied to striker bar 626. This shock may be applied by a wireline jar or other apparatus. This shock will cause shear pins 630 to shear, and striker bar 626 will impact piston 638, shearing shear pins 644. Because of the relatively large diameter of upper portion 642 of piston 638, hydrostatic pressure within chamber 634 will drive piston 638 downwardly, moving seals 658 past port 662 in housing 560. Chamber 682 in tubing release sub 562 is then exposed, through ports 660, to atmospheric pressure within chamber 647. Because of this low pressure in chamber 682, sliding sleeve 586 will be driven upwardly by hydrostatic pressure acting on the lower end of sliding sleeve 586, such as through port 600. Because sealing portion 650 of piston 638 will always seal within bore 653 of second sealing portion 561, hydrostatic pressure in chamber 670 will not be able to enter chamber 647.

The volume of chamber 647 is such that all fluid within chamber 682 may pass into chamber 647. The hydrostatic pressure acting upon sliding sleeve 586, shears pin 602, allowing sliding sleeve 586 to move upwardly until it contacts stop surface 690. As illustrated in phantom lines in FIG. 34B, once sliding sleeve 586 is moved upwardly, collet fingers 580 may move inwardly. The weight suspended from lower member 572 and the beveled surfaces on lugs 582 and recess 584 will cause collet fingers to move out of recess 584 and to release lower member 572 of tubing release sub 562.

Figure 35:
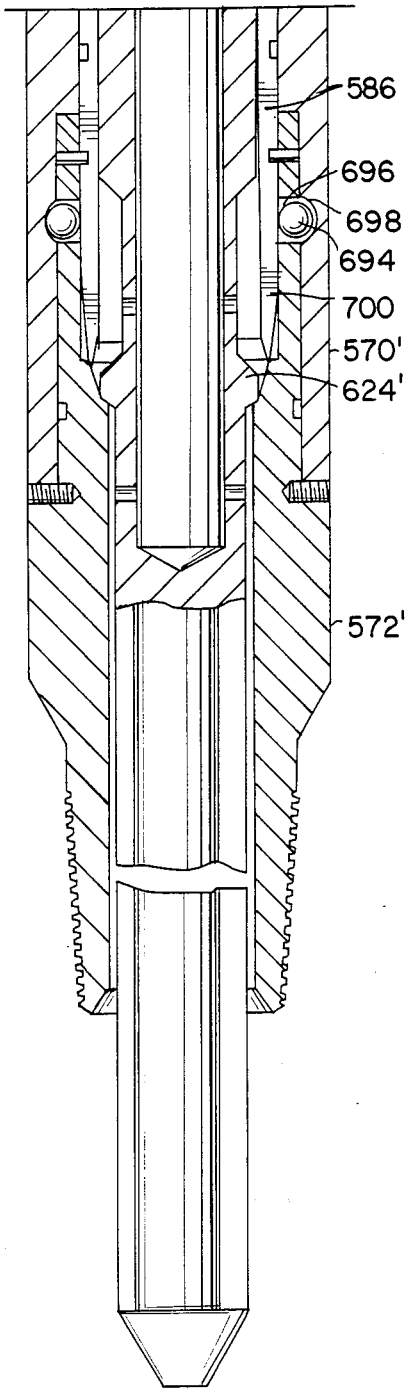
FIG. 35 depicts an alternative securing mechanism for use with the tubing release sub of FIG. 32.

Referring now to FIG. 35, therein is shown an alternative embodiment for the release mechanism of tubing release sub 562. Components functionally similar to those in tubing release sub 562 have been indicated with prime designations. In this embodiment, lower housing member 572' is coupled to member 570' by a plurality of retainer balls 694. Retainer balls 694 are held by retainer sleeve 586' in apertures 696 in lower member 572' and notches 698 in housing member 570'. Lower member 624' of atmospheric chamber actuator 520 includes a recessed portion 700.

When the actuation of atmospheric chamber actuator 560 coupled with hydrostatic pressure present causes sliding sleeve 586 to move upwardly, retaining balls 694 will fall out of notches 698 (into recessed portion 700) and lower member 572' will drop free of member 570' along with any equipment attached thereto.

Many modifications and variations may be made in the techniques and structures described and illustrated herein without departing from the scope of the present invention. For example, those skilled in the art will recognize that different types of sealing arrangements may be utilized with atmospheric chamber actuators as disclosed herein and well tools to be operated by such actuators. As an example, seals may be carried within the well tool to be operated rather than upon the actuator. Accordingly, it is to be clearly understood that the embodiments described and illustrated herein are illustrative only and are not to be considered as limitations on the scope of the present invention.

We claim:

1. An apparatus for hydraulically setting a hydraulically set packer within a well bore and for controlling the flow of well fluids into said apparatus, said apparatus attached to one end of a tubing string in said well and adapted to selectively sealingly engage the interior of said hydraulically set packer, said apparatus comprising:

a seal assembly having one end thereof connected to said tubing string and having seals thereon, a bore therethrough and a annular recess therein; and a hydraulic setting tool assembly connected to said hydraulically set packer for setting said hydraulically set packer in said well, said hydraulic setting tool assembly including:

a concentric sleeve having said hydraulically set packer therein;

a packer actuating sleeve slidably with respect to the concentric sleeve and releasably secured thereto, the packer actuating sleeve having a portion thereof engaging a portion of said hydraulically set packer on the concentric sleeve;

a housing releasably secured to the concentric sleeve and having a portion thereof abutting the packer actuating sleeve;

an inner mandrel slidable within the housing and engaging a portion of said seal assembly, the inner mandrel having ports therein in fluid communication with the bore in the said seal assembly;

a piston slidably within the annular space between the housing and the inner mandrel, the piston having a portion thereof connected to a portion of the packer actuating sleeve, and capable of being actuated by fluid pressure communicated to the piston thereon by the bore in said seal assembly and the ports in the inner mandrel; and a cap secured to a portion of the housing and a portion of the inner mandrel closing the annular space located between the housing and the inner mandrel located above the piston.

2. The apparatus of claim 1 wherein said apparatus is connected to a perforating gun located below said hydraulically set packer, said perforating gun being releasably connected to said hydraulic setting tool.

3. The apparatus of claim 1 wherein said hydraulic setting tool further includes:

a housing extension connected to the housing, the housing extension having ports therein; and a slidable member releasably slidably retained within the housing extension in a first and second position therein, the slidable member having a portion thereof sealingly engaging the housing extension preventing the flow of said well fluids into said apparatus through the ports in the housing extension, when the slidable member is in the first position within the housing extension, the slidable member allowing the flow of said well fluids into said apparatus through the ports in the housing extension when the second position in the housing extension; and said seal assembly includes;

an extension having ports therein and having a peripheral flange thereon for moving the slidable member within the housing extension between its first and second positions therein when said seal assembly is reciprocated within the housing extension.

4. The apparatus of claim 1 wherein the hydraulic setting tool assembly further includes:

a packer body sleeve having one end thereof connected to one end of the concentric sleeve and having a portion thereof abutting a portion of said hydraulically set packer.

5. The apparatus of claim 1 wherein said seal assembly is releasably retained within said hydraulic setting tool in a first position by lug means extending through the cap of said hydraulic setting tool and engaging the annular recess in said seal assembly.

6. The apparatus of claim 5 wherein the lug means extending through the cap of said hydraulic setting tool are releasably in position with the annular recess in said seal assembly by a portion of the piston abutting a portion of the lug means.

7. The apparatus of claim 1 wherein the piston is releasably retained within a first position within the annular space between the housing and the inner mandrel of said hydraulic setting tool.

8. The apparatus of claim 7 wherein the piston is releasably retained within the annular space between the housing and the inner mandrel of said hydraulic setting tool by a portion of the piston being releasably retained to a portion of the cap.

9. The apparatus of claim 1 wherein said seal assembly includes ports therein and said apparatus is connected to a perforating gun located below said hydraulically set packer, said perforating gun being releasably connected to said seal assembly.

* * * * *